US010371430B2

(12) United States Patent
Kim et al.

(10) Patent No.: US 10,371,430 B2
(45) Date of Patent: Aug. 6, 2019

(54) REFRIGERATOR AND MANUFACTURING METHOD THEREOF

(71) Applicant: Samsung Electronics Co., Ltd., Suwon-si (KR)

(72) Inventors: Bong Ku Kim, Gwangju (KR); Si Ho Jang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 150 days.

(21) Appl. No.: 15/329,088

(22) PCT Filed: Mar. 25, 2015

(86) PCT No.: PCT/KR2015/002928
§ 371 (c)(1),
(2) Date: Jan. 25, 2017

(87) PCT Pub. No.: WO2016/013746
PCT Pub. Date: Jan. 28, 2016

(65) Prior Publication Data

US 2018/0202701 A1 Jul. 19, 2018

(30) Foreign Application Priority Data

Jul. 25, 2014 (KR) ..... 10-2014-0094497

(51) Int. Cl.
*F25D 11/04* (2006.01)
*F25D 11/00* (2006.01)
(Continued)

(52) U.S. Cl.
CPC ..... *F25D 11/04* (2013.01); *F25D 11/00* (2013.01); *F25D 23/00* (2013.01); *F25D 23/028* (2013.01);
(Continued)

(58) Field of Classification Search
CPC ..... F25D 11/04; F25D 11/00; F25D 23/00; F25D 23/028; F25D 23/06; F25D 23/069;
(Continued)

(56) References Cited

U.S. PATENT DOCUMENTS 5,577,822 A * 11/1996 Seon ..... F25D 17/065 312/401
5,855,953 A * 1/1999 Cao ..... C04B 41/009 427/226
(Continued)

FOREIGN PATENT DOCUMENTS

CN 1378635 11/2002
CN 102116554 7/2011
(Continued)

OTHER PUBLICATIONS

Extended European Search Report dated Jan. 23, 2018 in European Patent Application No. 15824023.4.
(Continued)

*Primary Examiner* — Hanh V Tran
(74) *Attorney, Agent, or Firm* — Staas & Halsey LLP

(57) ABSTRACT

Provided are a refrigerator including an aerogel serving as an auxiliary insulation material and a manufacturing method thereof.
The refrigerator includes a main body including an inner case constituting a storage compartment and an outer case disposed outside the inner case, a main insulation material disposed between the inner case and the outer case, and an aerogel coating layer formed on a rear surface of the inner case or a front surface of the outer case by coating a liquid-phase aerogel and curing the aerogel.

16 Claims, 23 Drawing Sheets

(51) Int. Cl.

| | |
|---|---|
| ***F25D 23/00*** | (2006.01) |
| ***F25D 23/06*** | (2006.01) |
| ***F25D 23/02*** | (2006.01) |
| ***F25J 1/02*** | (2006.01) |
| ***F25J 3/04*** | (2006.01) |

(52) U.S. Cl.
CPC ..... *F25D 23/06* (2013.01); *F25D 23/069* (2013.01); *F25J 1/0261* (2013.01); *F25J 3/04945* (2013.01); *F17C 2203/0325* (2013.01); *F25D 2323/024* (2013.01); *F25J 2290/30* (2013.01)

(58) Field of Classification Search
CPC ..... F25D 2323/024; F25J 1/0261; F25J 3/04945; F25J 2290/30; F17C 2203/0325
See application file for complete search history.

(56) References Cited

U.S. PATENT DOCUMENTS 5,990,184 A * 11/1999 Biesmans ..... C08G 18/092 521/125
6,305,768 B1 * 10/2001 Nishimoto ..... B29C 44/1242 220/592.09
6,860,082 B1 * 3/2005 Yamamoto ..... B62D 33/048 52/794.1
7,638,181 B2 * 12/2009 Tenra ..... B32B 3/04 312/406
8,778,477 B2 * 7/2014 Hwang ..... F16L 59/065 428/69
8,881,398 B2 * 11/2014 Hanley ..... F25D 23/064 29/469
2002/0153817 A1 * 10/2002 Wenning ..... F25D 23/064 312/406
2003/0090188 A1 * 5/2003 Gamberoni ..... F25D 23/062 312/406
2004/0174106 A1 * 9/2004 Uekado ..... F25D 23/062 312/401
2006/0093808 A1 * 5/2006 Sullivan ..... C01B 33/157 428/319.3
2008/0280090 A1 * 11/2008 Kim ..... B32B 3/04 428/69
2008/0303400 A1 * 12/2008 Kim ..... F25D 23/02 312/401
2009/0082479 A1 * 3/2009 Cho ..... C09D 127/16 521/141
2009/0179541 A1 * 7/2009 Smith ..... B29C 63/02 312/406
2011/0031861 A1 * 2/2011 Gentry ..... E04B 1/76 312/406
2011/0220099 A1 * 9/2011 Flaherty ..... F16L 59/065 126/709
2012/0009376 A1 * 1/2012 Rusek, Jr. ..... B32B 15/18 428/69
2013/0026900 A1 * 1/2013 Oh ..... F25D 23/02 312/401
2014/0121298 A1 * 5/2014 Yang ..... G03G 15/2057 523/218

FOREIGN PATENT DOCUMENTS

| | | |
|---|---|---|
| CN | 102700190 | 10/2012 |
| JP | 2004-340415 | 12/2004 |
| JP | 2004-340420 | 12/2004 |
| KR | 1999-007715 | 2/1999 |
| KR | 10-2009-0030635 | 3/2009 |
| KR | 10-2011-0039788 | 4/2011 |
| KR | 10-2012-0063316 | 6/2012 |
| WO | 2010/033288 | 3/2010 |
| WO | 2011/152610 A1 | 12/2011 |

OTHER PUBLICATIONS

European Communication dated Mar. 10, 2017 in European Patent Application No. 15824023.4.
International Search Report dated Jun. 29, 2015 in corresponding International Application No. PCT/KR2015/002928.
European Patent Office issued Communication pursuant to Article 94(3)EPC in European Patent Application No. 15824023.4 dated Apr. 2, 2019(4 pages).
Chinese Patent Office issued First Office Action in Chinese Patent Application No. 201580051249.8 dated Jan. 30, 2019 (Total 20 pages).

* cited by examiner

[Fig. 1]
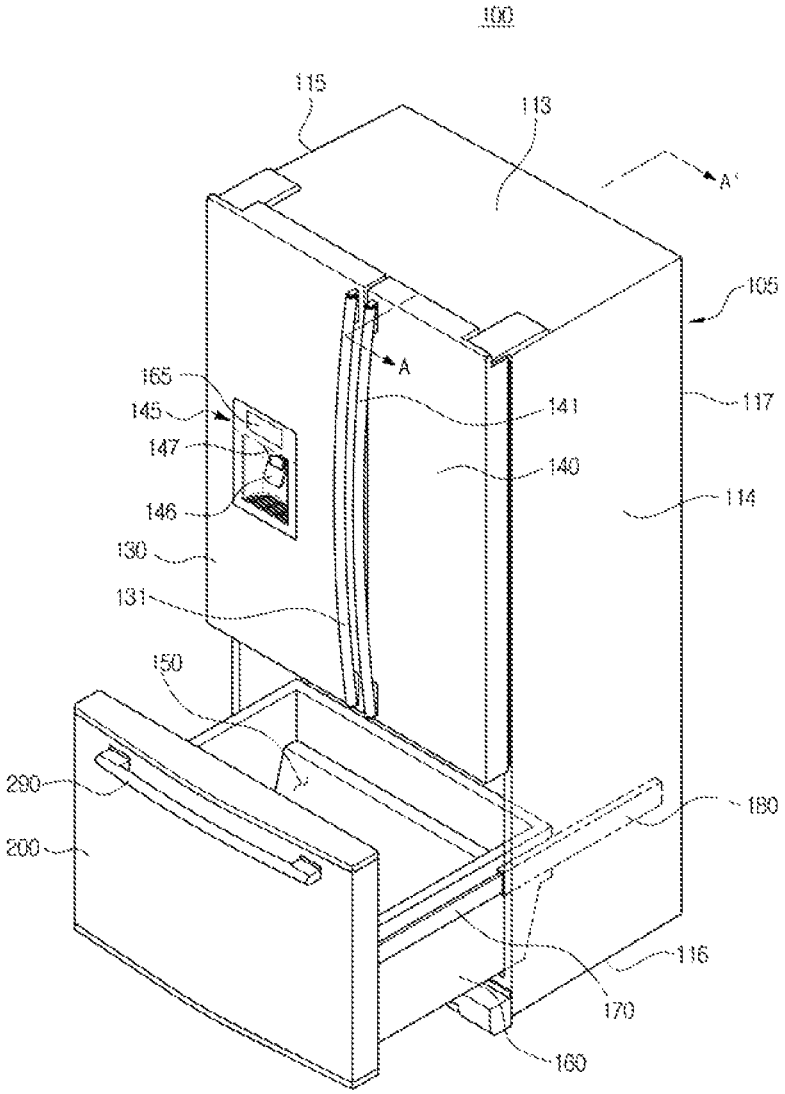

[Fig. 2]
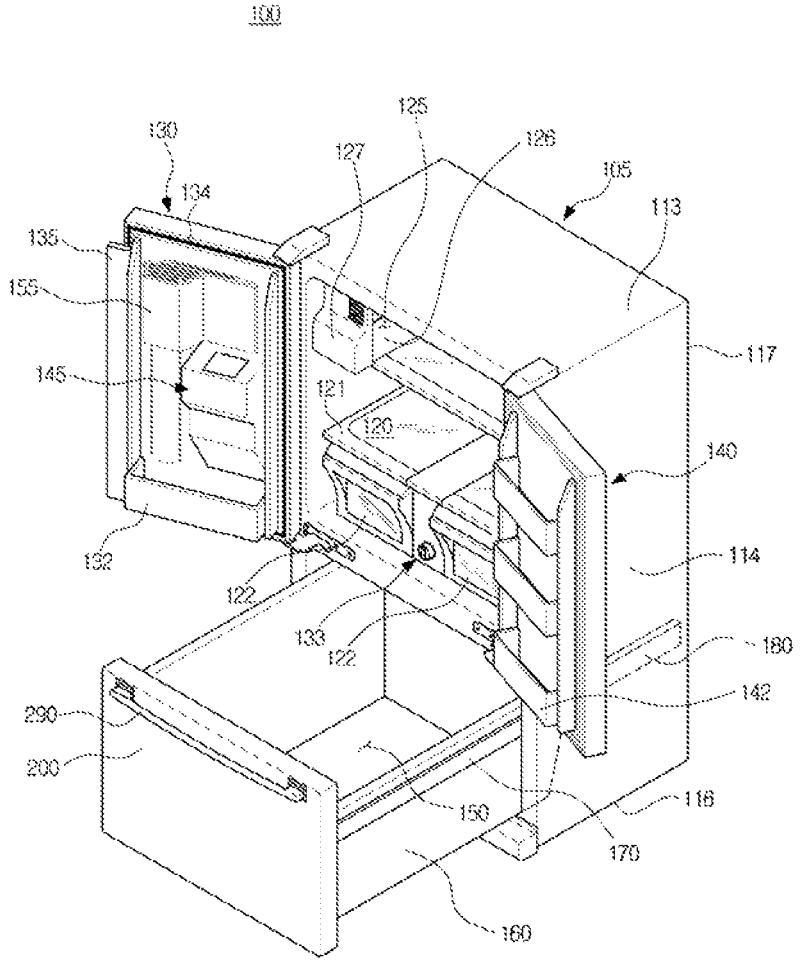

[Fig. 3]
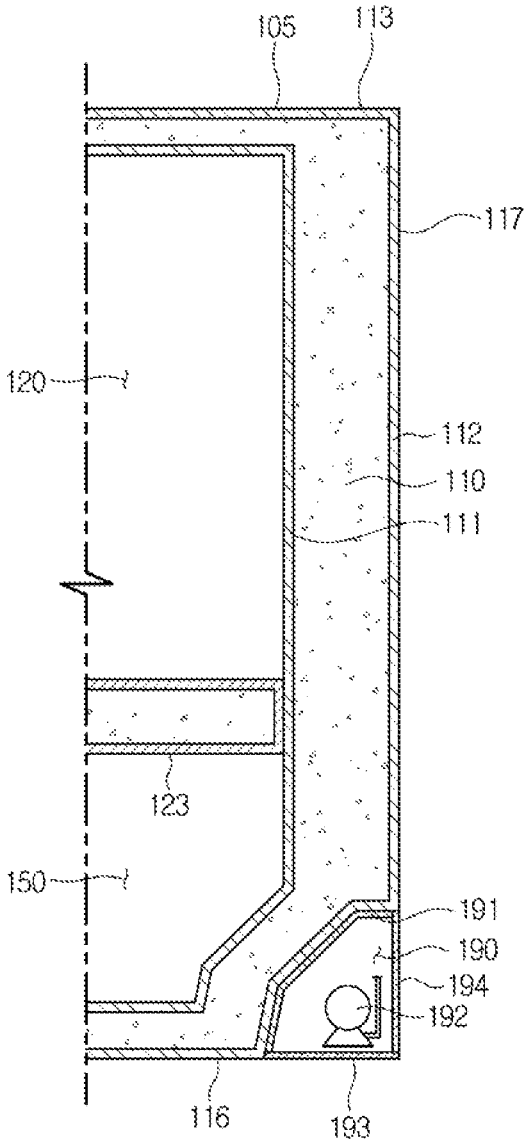

[Fig. 4a]
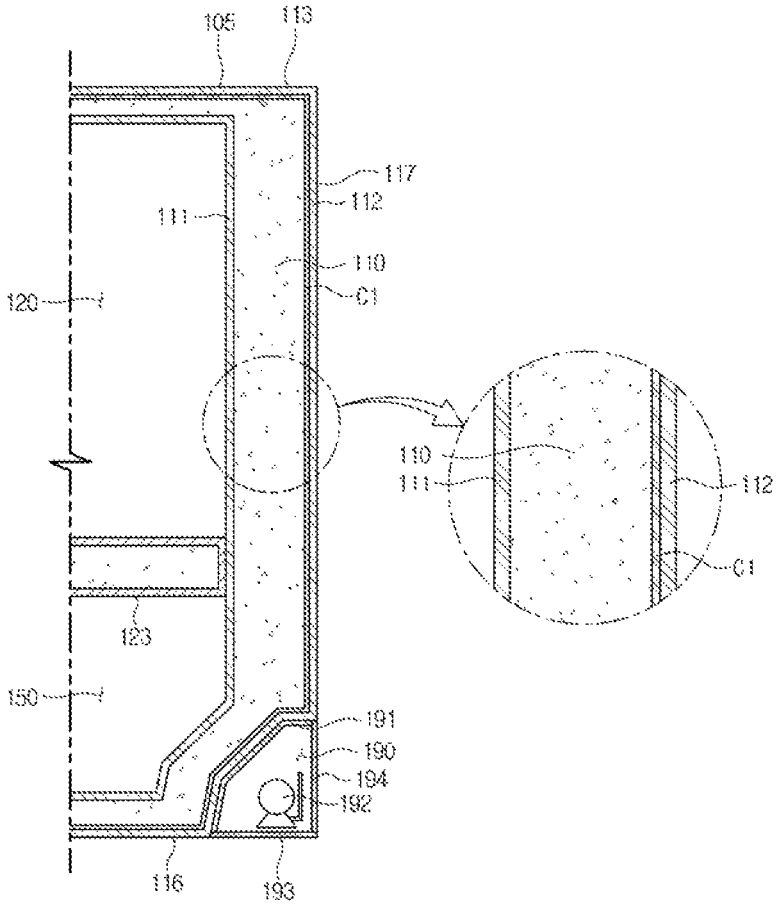

[Fig. 4b]
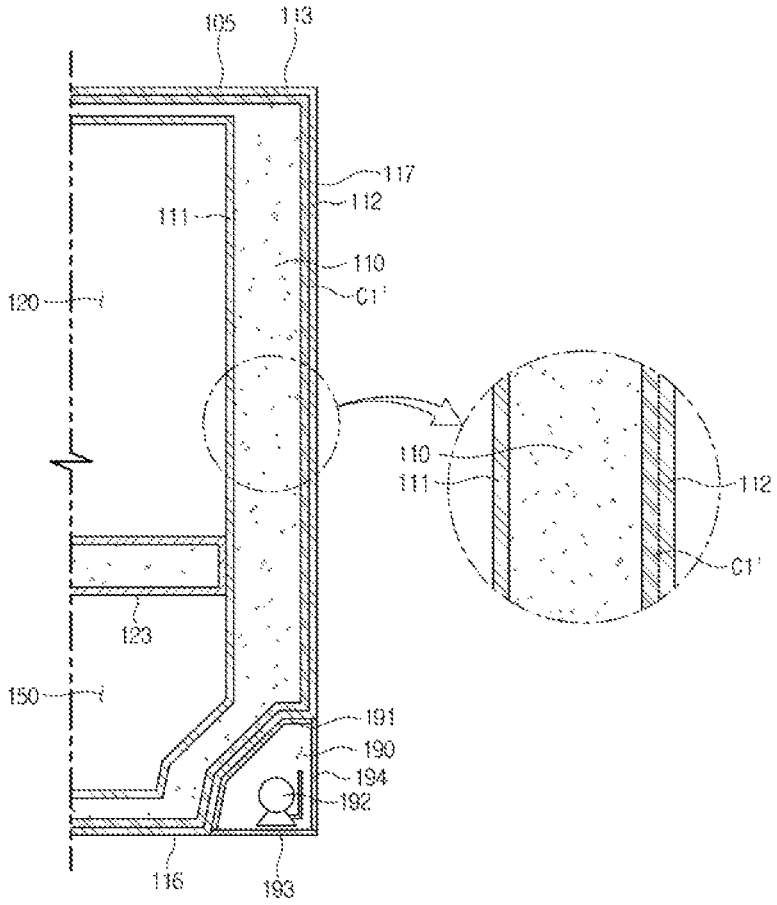

[Fig. 4c]
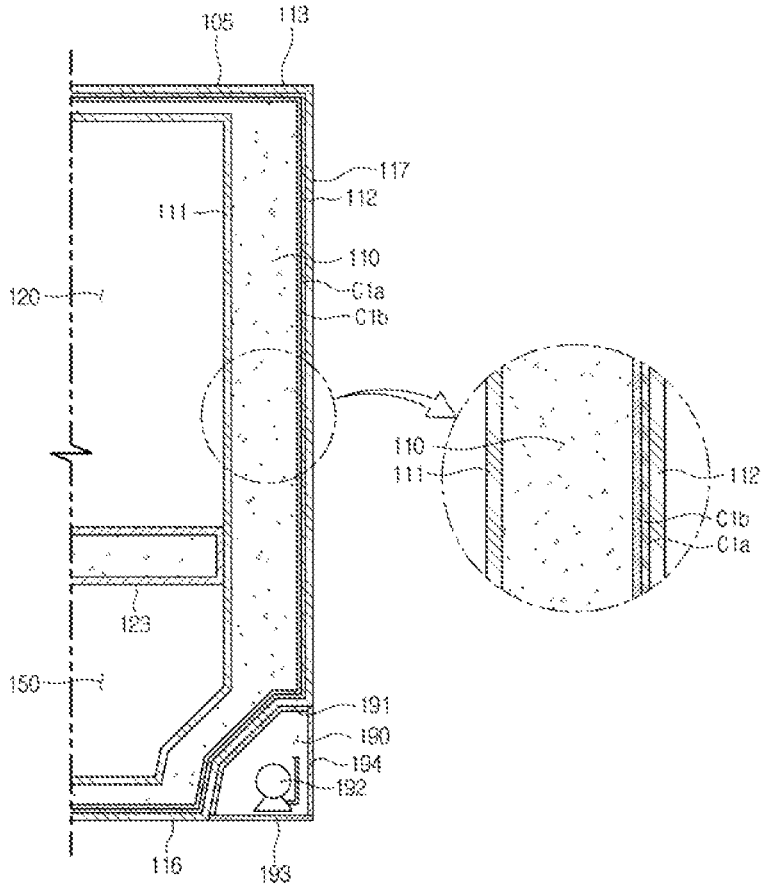

[Fig. 4d]
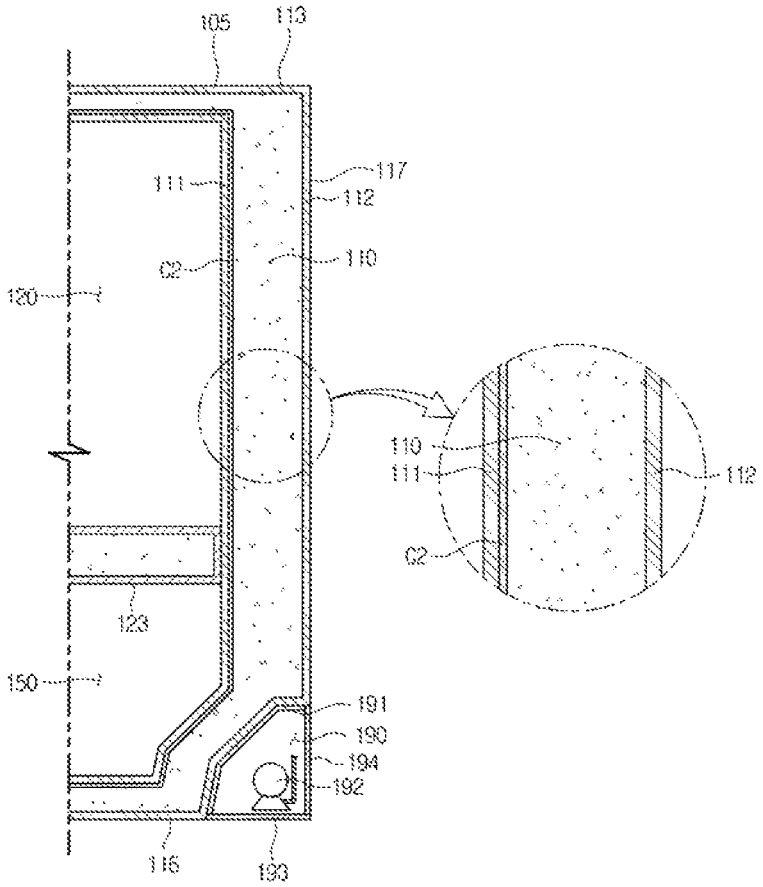

[Fig. 4c]
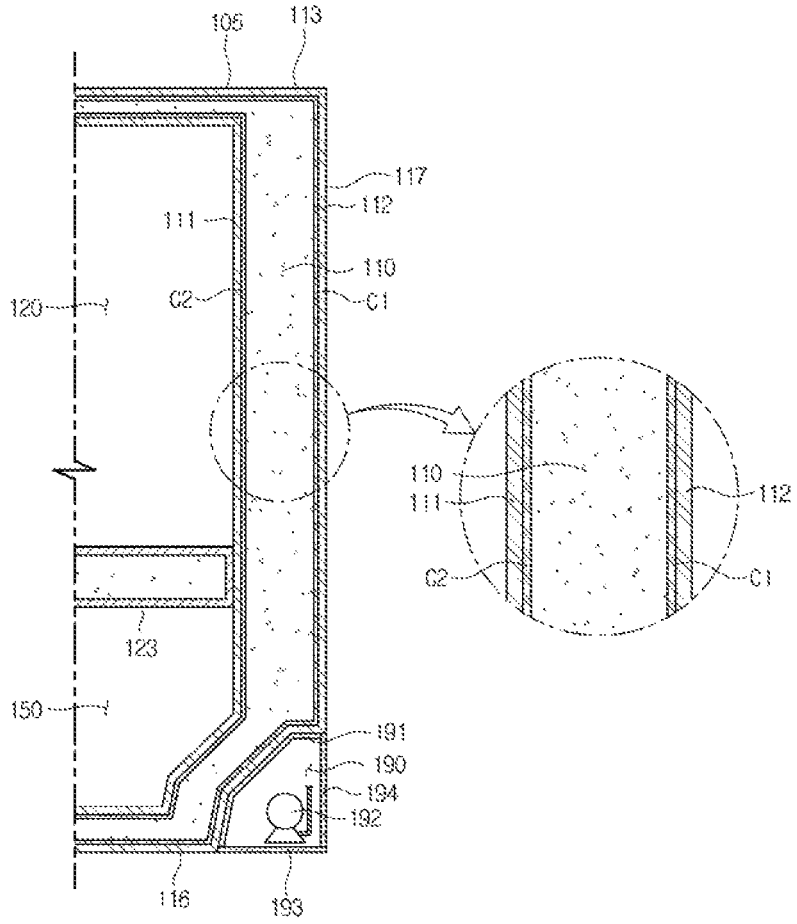

[Fig. 5]
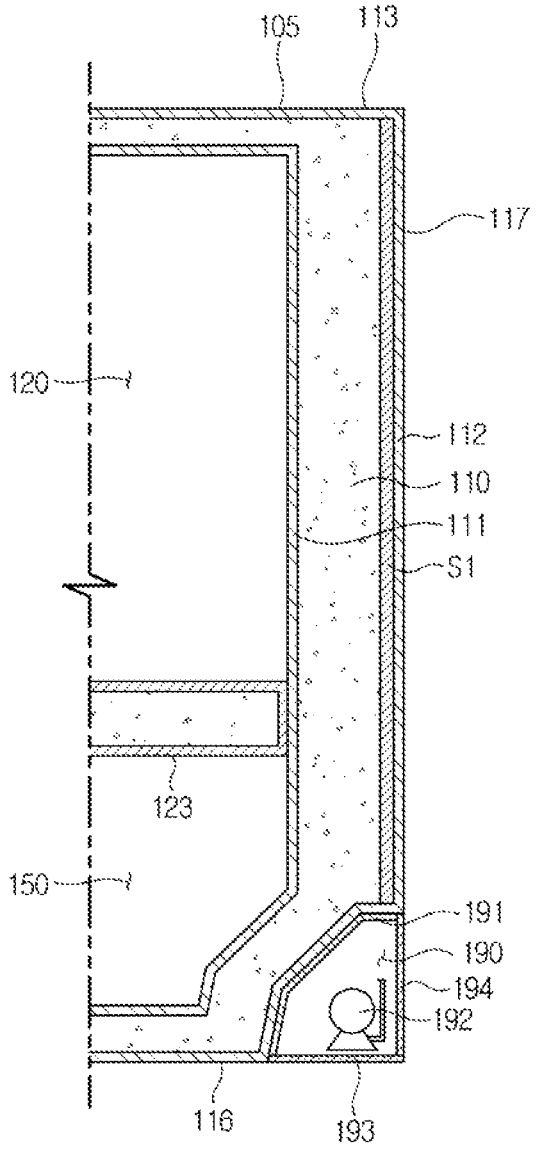

[Fig. 6]
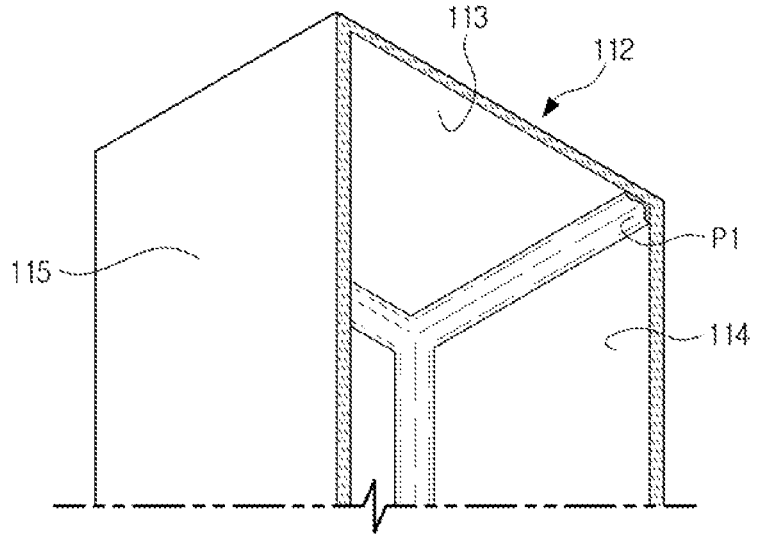
[Fig. 7]
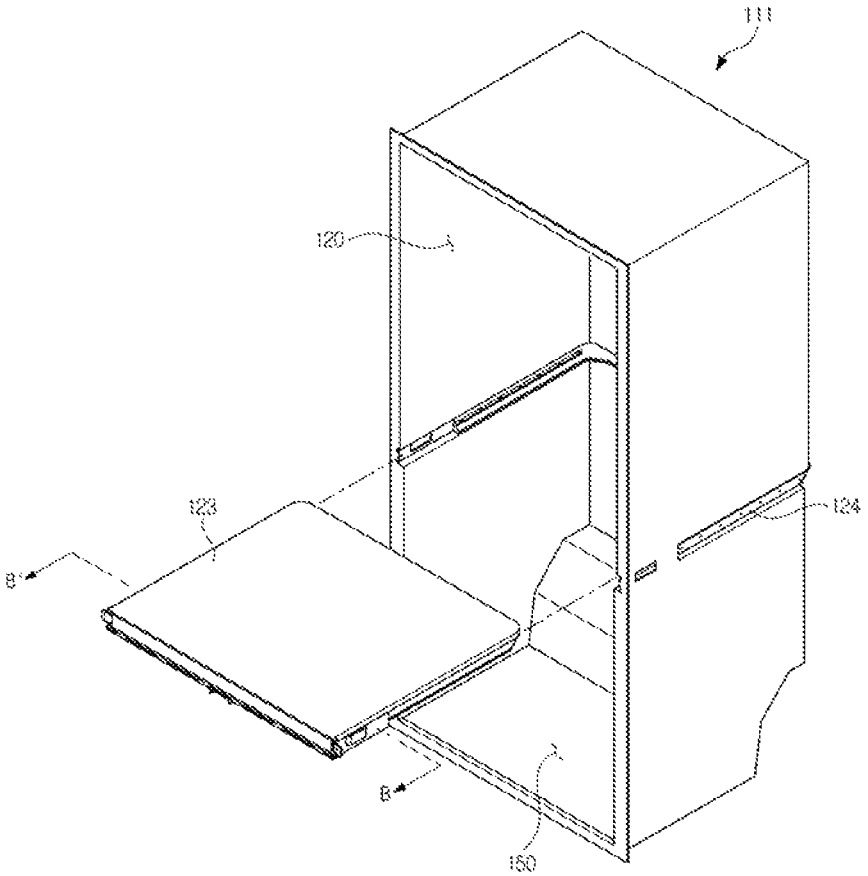

[Fig. 8]
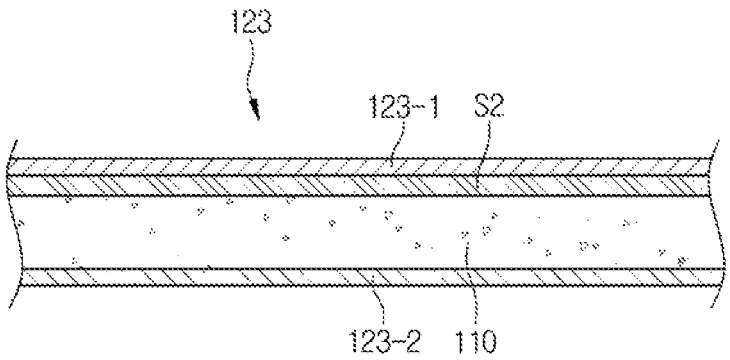
[Fig. 9a]
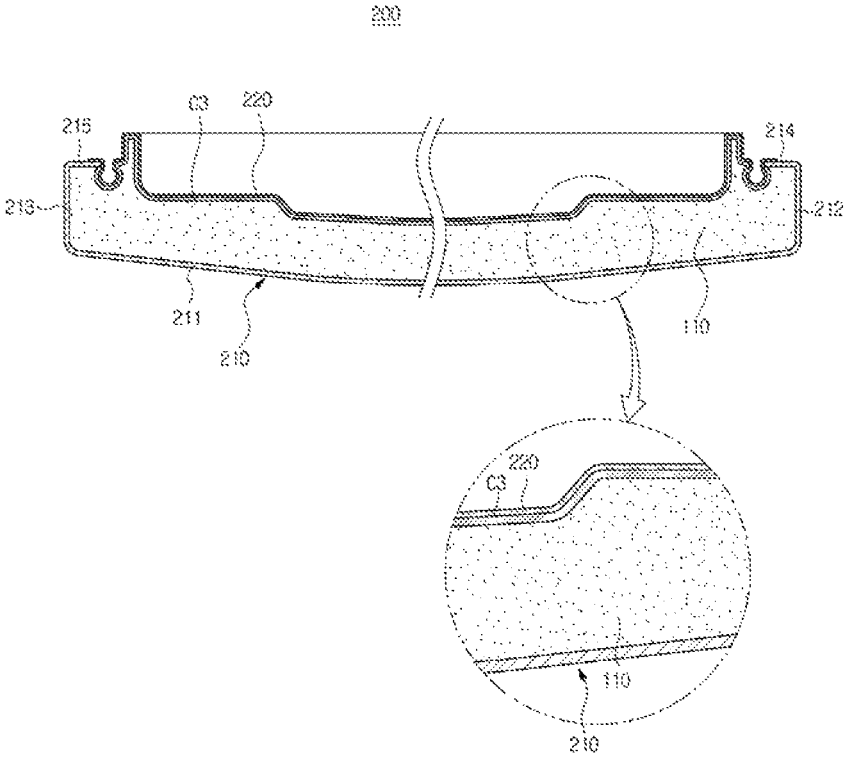

[Fig. 9b]
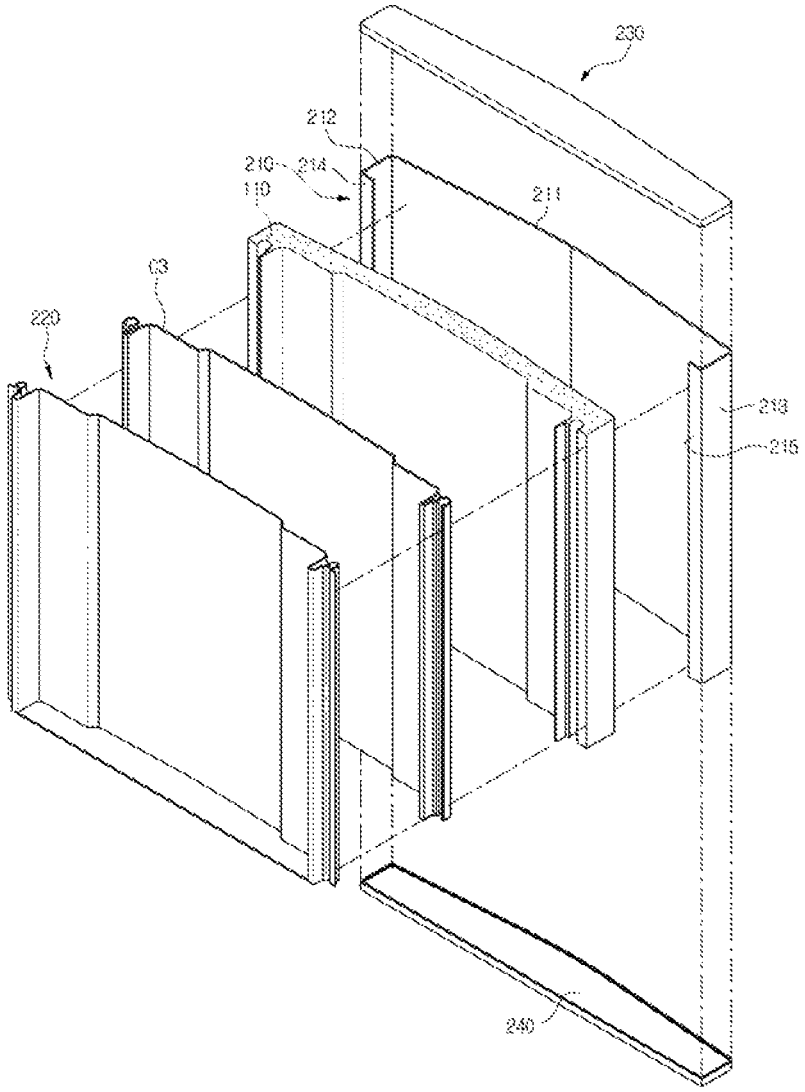

[Fig. 9c]
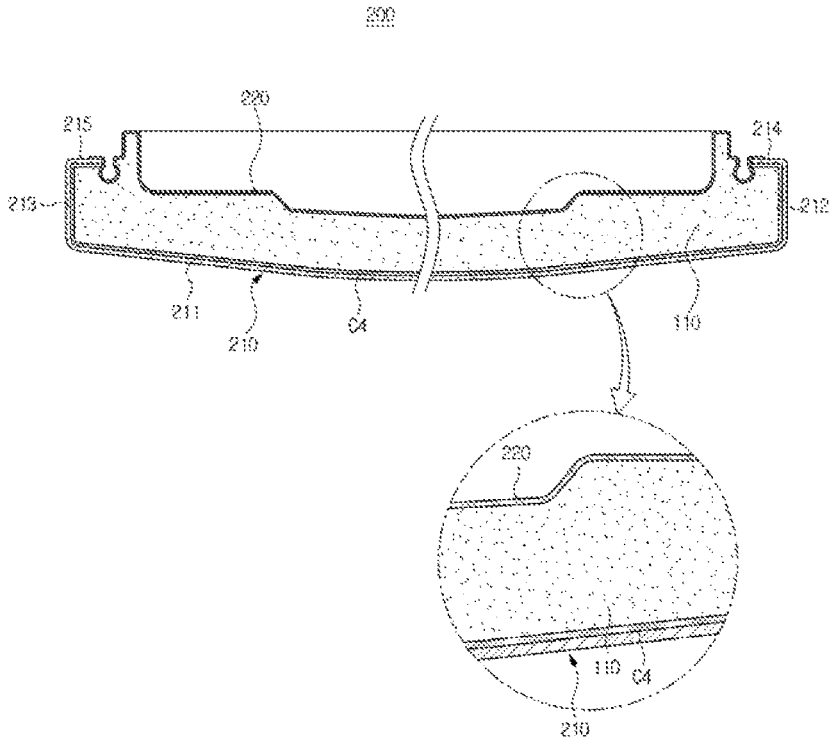
[Fig. 9d]
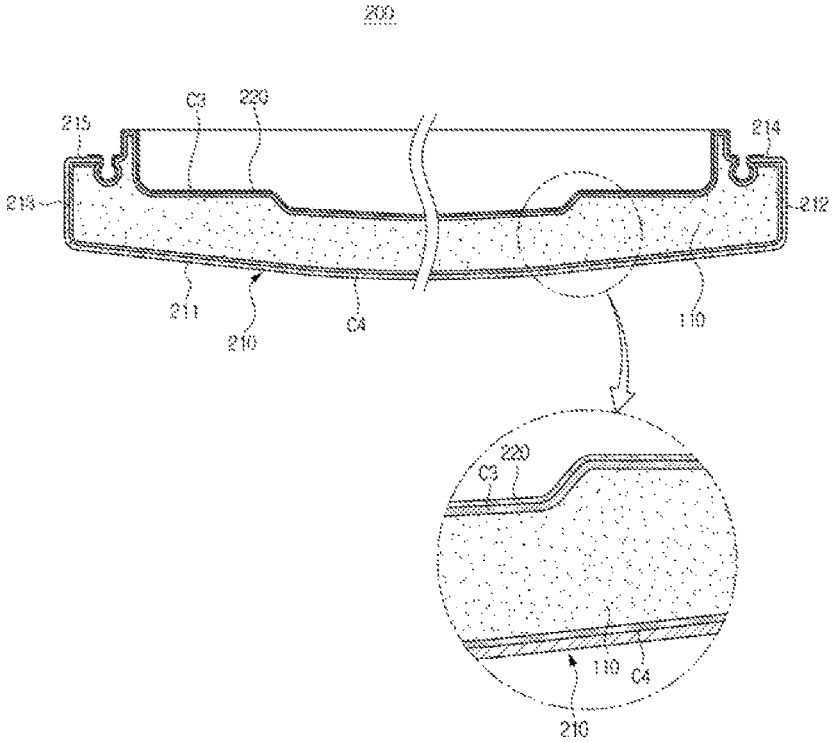

[Fig. 10]
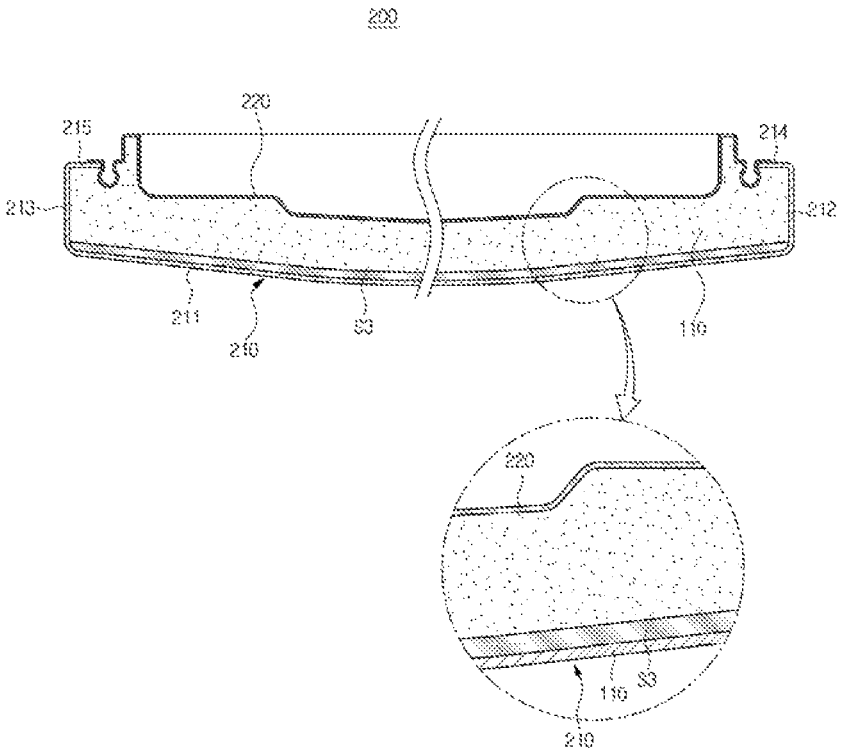
[Fig. 11a]
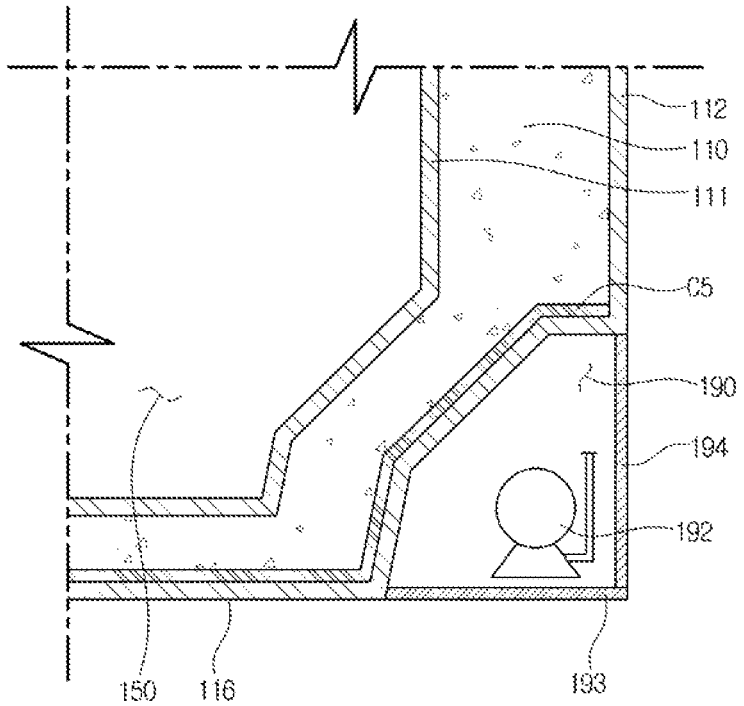

[Fig. 11b]
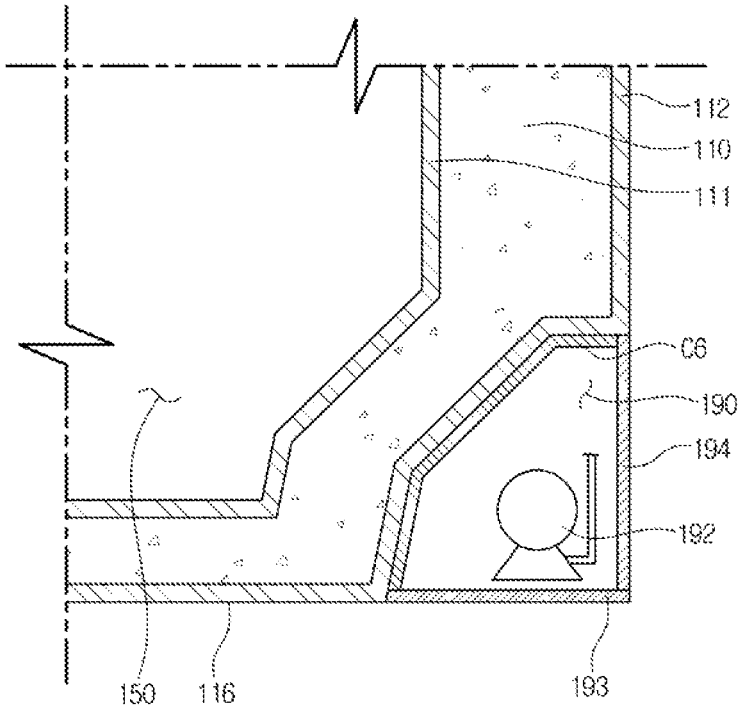
[Fig. 11c]
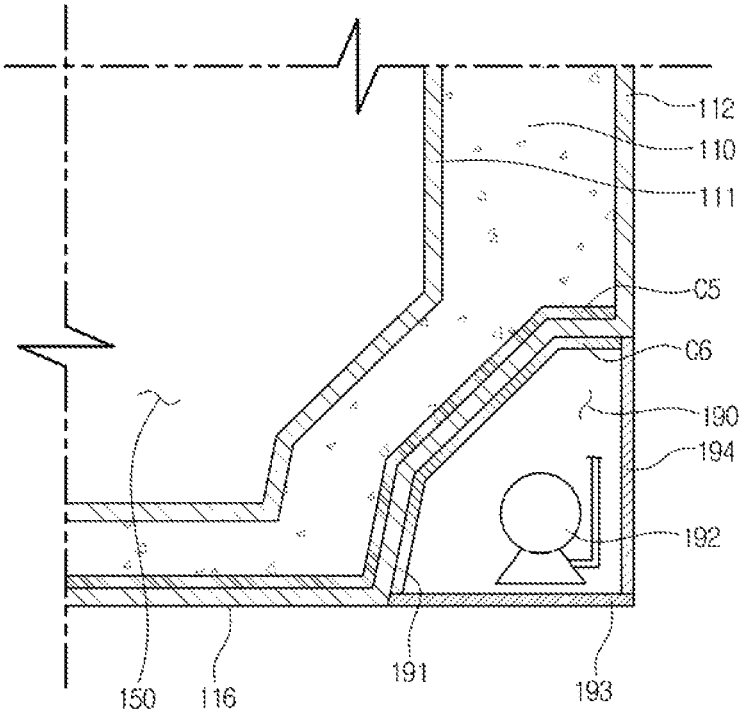

[Fig. 11d]
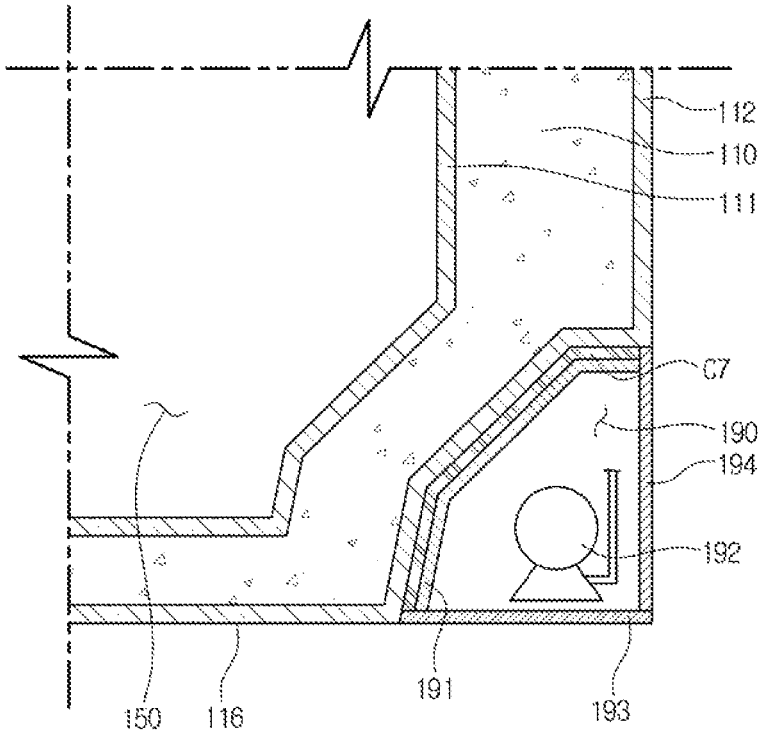
[Fig. 11e]
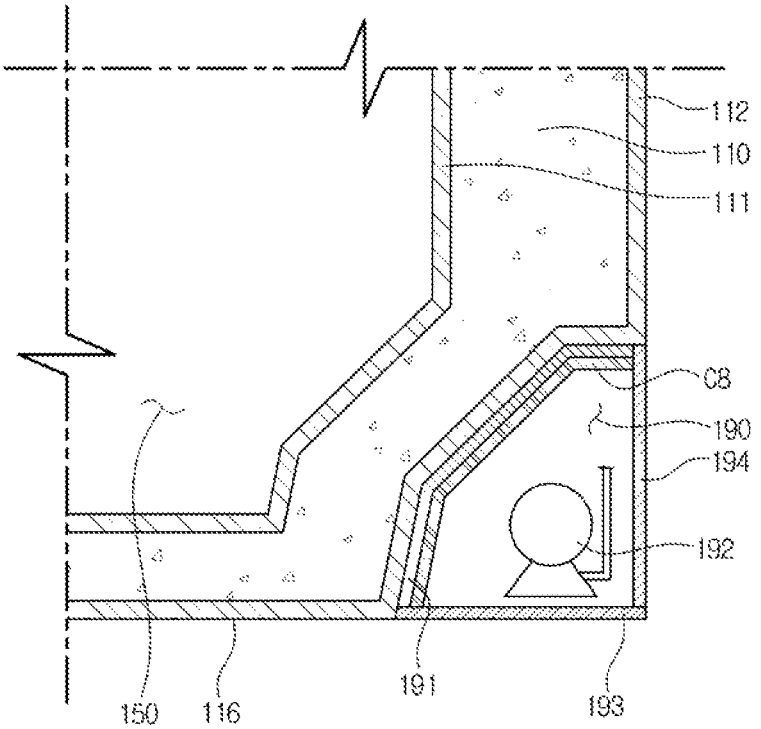

[Fig. 11f]
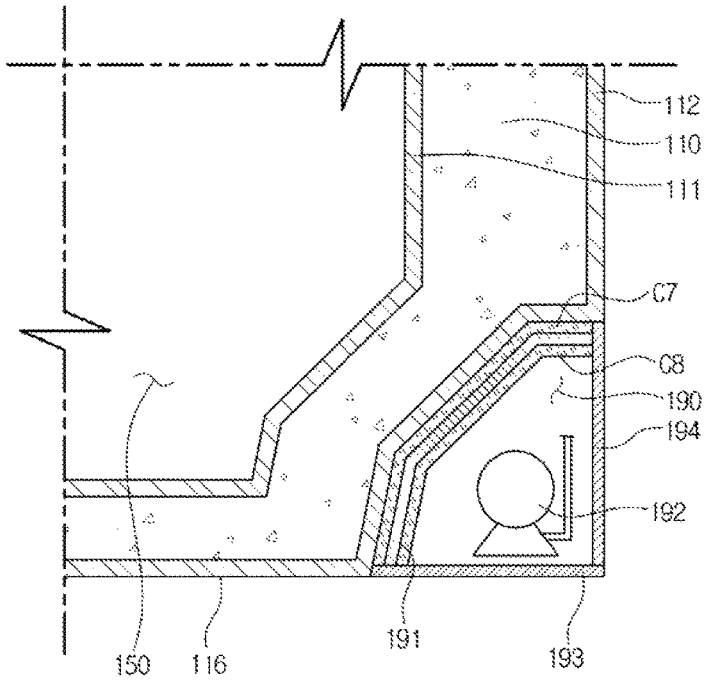

[Fig. 12]
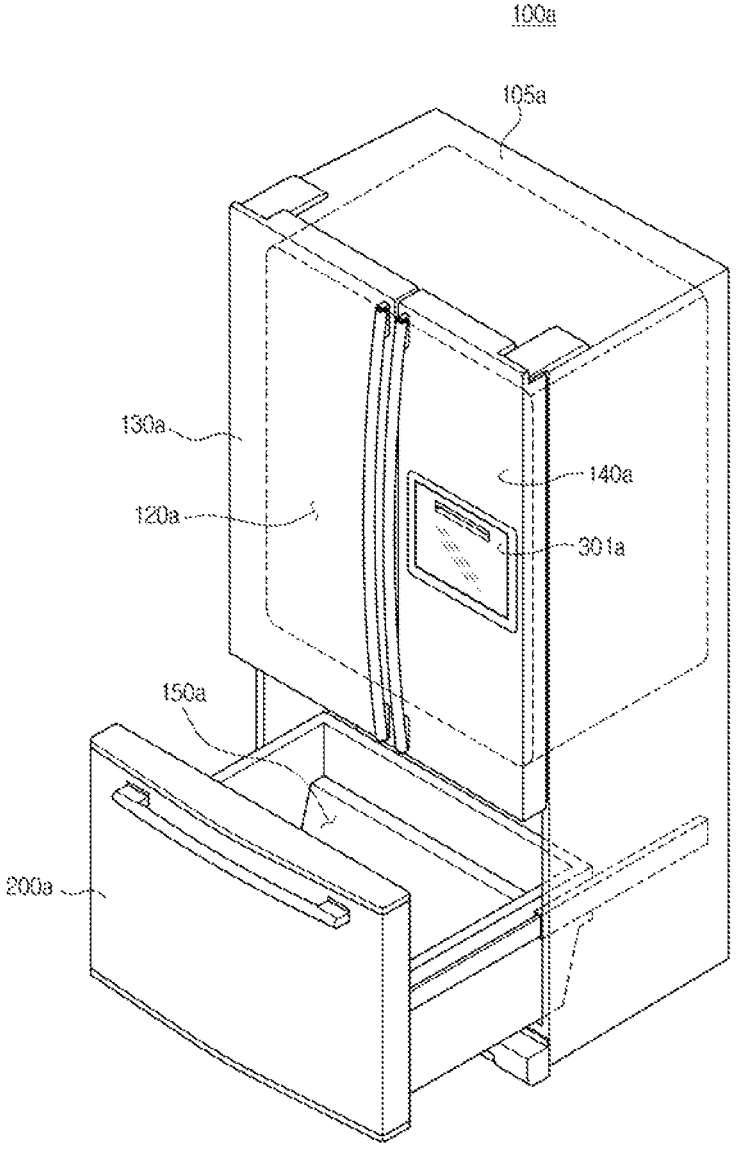

[Fig. 13]
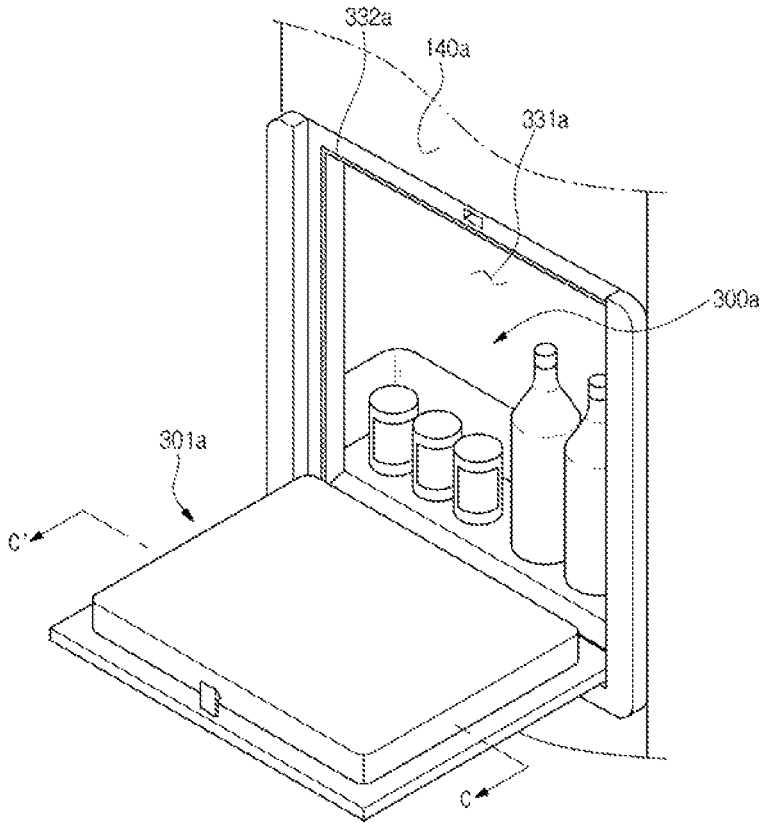
[Fig. 14]
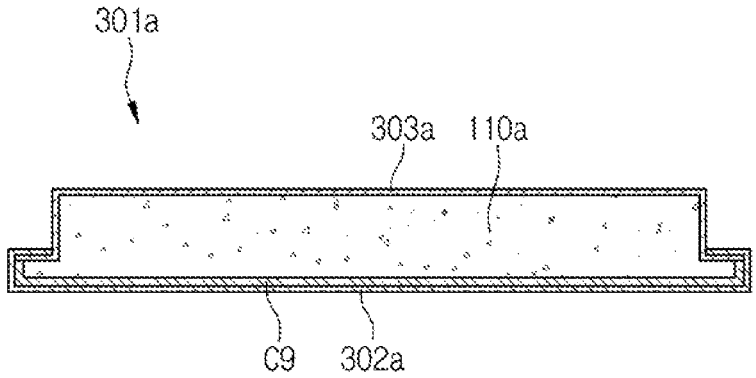

[Fig. 15]
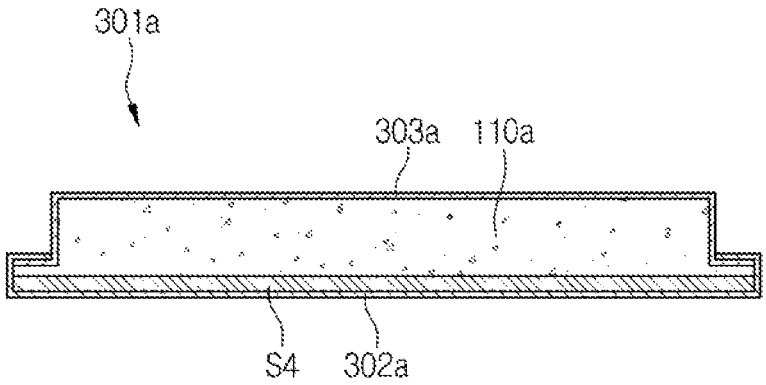
[Fig. 16]
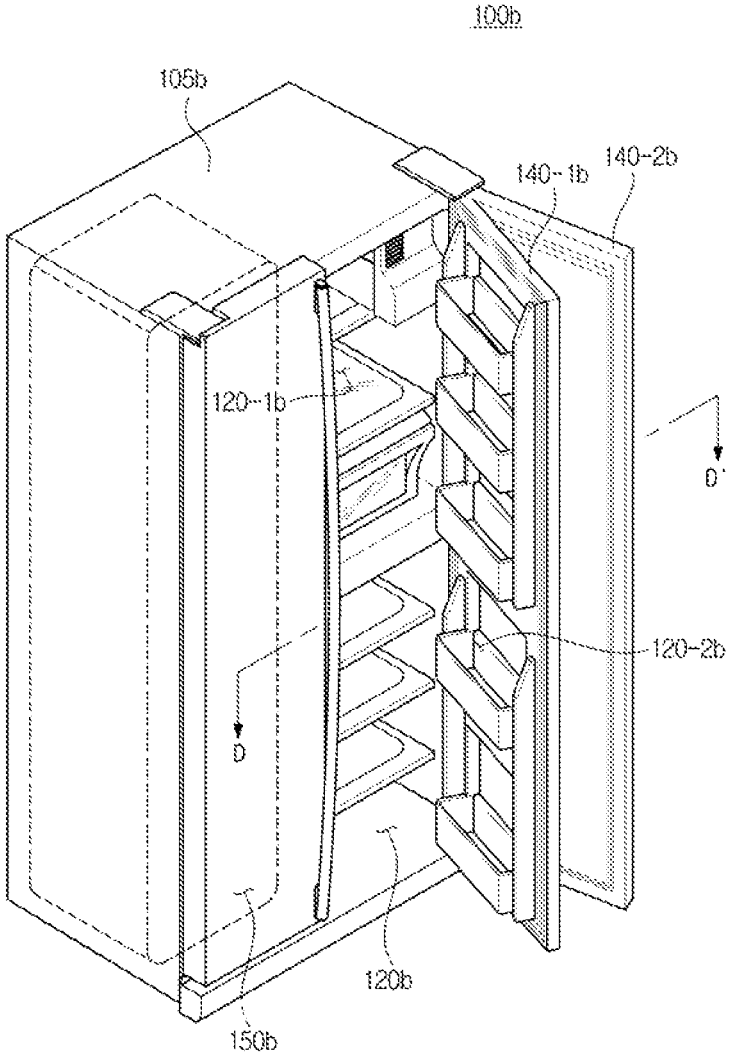

[Fig. 17]
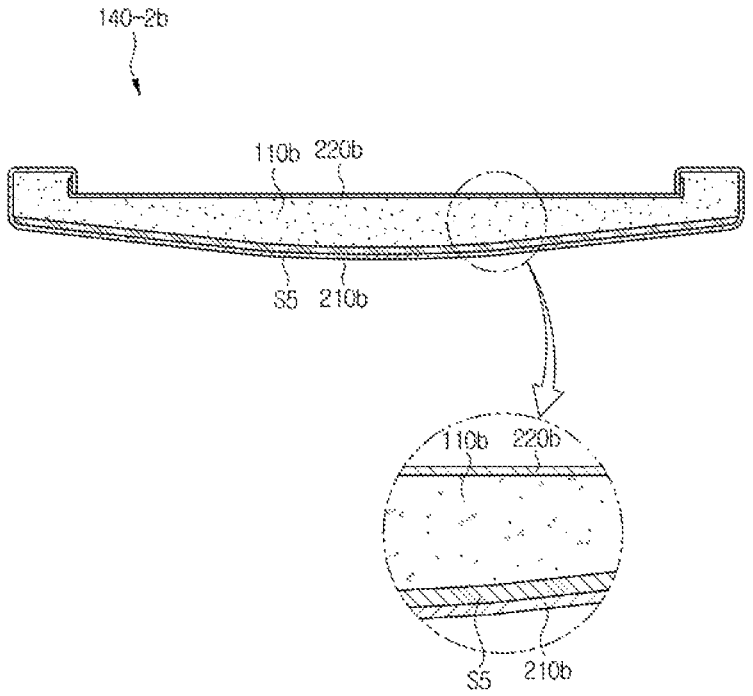
[Fig. 18]
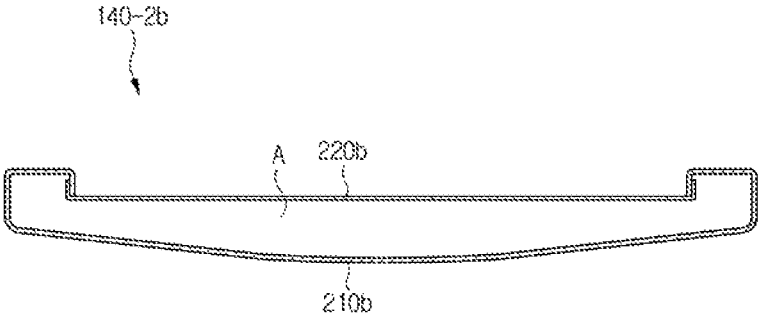

[Fig. 19]
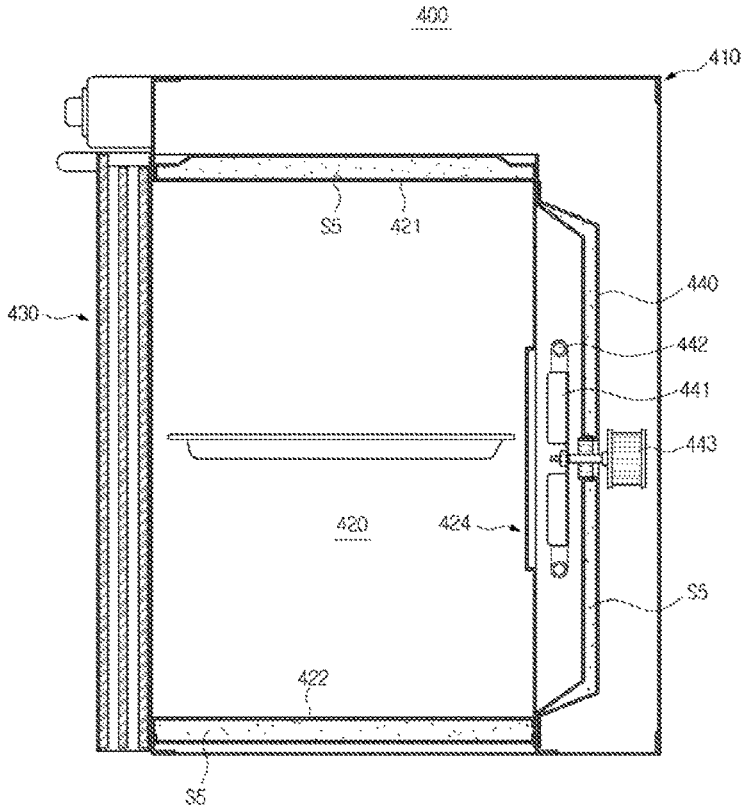
[Fig. 20]
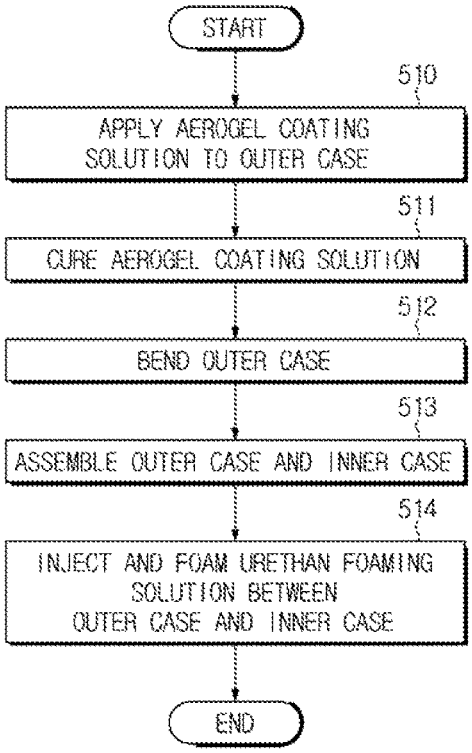

[Fig. 21]
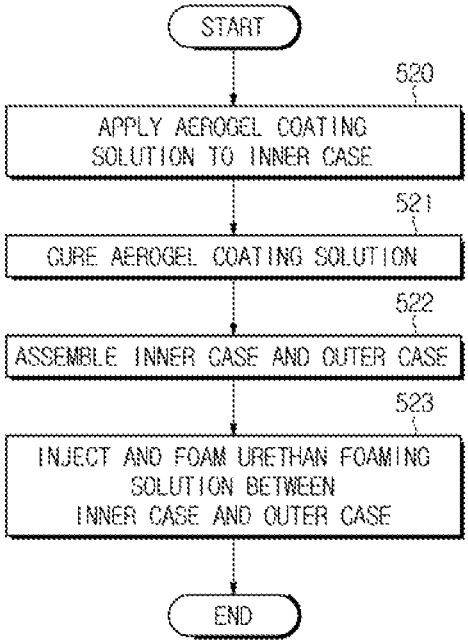

REFRIGERATOR AND MANUFACTURING METHOD THEREOF

CROSS-REFERENCE TO RELATED APPLICATIONS

This application is a U.S. National Stage Application, which claims the benefit under 35 U.S.C. § 371 of PCT International Patent Application No. PCT/KR2015/002928, filed Mar. 25, 2015 which claims the foreign priority benefit under 35 U.S.C. § 119 of Korean Patent Application No. 10-2014-0094497, filed Jul. 25, 2014, the contents of which are incorporated herein by reference.

TECHNICAL FIELD

The present invention relates to a refrigerator and a manufacturing method thereof, and more particularly, to a refrigerator including an insulation wall formed using an aerogel and a manufacturing method thereof.

BACKGROUND ART

A refrigerator is a home appliance to allow a user to keep food fresh. Conventional refrigerators have a thermally insulated structure prepared by filling a urethane foaming liquid in an empty space of an assembled structure of an outer case and an inner case, by filling a urethane foaming liquid in an empty space of an assembled structure of an outer case having a vacuum insulation panel (VIP) attached to an inner surface thereof and an inner case, or by mixing an aerogel with the urethan foaming liquid.

Decrease in power consumption is limited by using insulation walls having a structure including only urethan foam unless thickness of an insulation material is increased. As the thickness of the insulation material increases, a volume of an inner space of a refrigerator decreases and an amount of urethane foaming liquid increases, thereby increasing manufacturing costs of the refrigerator.

If the vacuum insulation panel (VIP) is applied to decrease power consumption, the vacuum state of the VIP may be destroyed resulting in difficulty in maintaining power consumption, a space for urethane form is not sufficient due to the introduction of the VIP, and a cabinet of the refrigerator may have a non-uniform surface.

Also, the insulation wall formed by mixing a urethan foaming liquid with an aerogel may not have sufficient heat-insulating performance since independent foam generated while curing urethane may be destroyed by the aerogel.

DISCLOSURE

Technical Problem

An aspect of the present disclosure is to provide a refrigerator to which an aerogel is applied in the form of a coating layer or a paste.

Another aspect of the present disclosure is to provide a refrigerator to which a cryogenic aerogel or a pyrogenic aerogel is applied.

Another aspect of the present disclosure is to provide a refrigerator in which an aerogel coating layer is applied to an inner surface of a refrigerator door, an inner surface of a refrigerator main body, a surface of a refrigerator machine room case, or an inner surface of a refrigerator home bar door in contact with a urethane insulation material or an aerogel paste is applied to edges or the like of the refrigerator.

Technical Solution

In accordance with an aspect of the present disclosure, there is provided a refrigerator including: a main body including an inner case constituting a storage compartment and an outer case disposed outside the inner case; a main insulation material disposed between the inner case and the outer case; and an aerogel coating layer formed on a rear surface of the inner case or a front surface of the outer case by coating a liquid-phase aerogel and curing the aerogel, wherein the aerogel coating layer serves as an auxiliary insulation material of the main insulation material.

The aerogel coating layer may be formed by coating an aerogel coating solution by a nozzle spray method or a roller method.

The aerogel coating layer may be formed by curing an aerogel coating solution selected from the group consisting of an organic binder coating solution, an inorganic binder coating solution, and a waterborne coating solution.

The aerogel coating layer may be formed by curing an aerogel coating solution by room temperature curing or heating curing.

The aerogel coating layer may include at least one selected from the group consisting of a cryogenic aerogel and a pyrogenic aerogel.

The aerogel coating layer may be formed on a portion of one surface of the entire surface or the inner case or the outer case.

The aerogel coating layer may be formed on at least one of one surface of the inner case in contact with the main insulation material and one surface of the outer case in contact with the main insulation material.

The aerogel coating layer may be formed on one surface of the main insulation material.

The main insulation material may include at least one selected from the group consisting of a filled and cured foam insulation material, a pre-processed foam insulation material, and a vacuum insulation panel (VIP).

The refrigerator may further include a door including: an inner panel; an outer panel disposed outside the inner panel; a main insulation material disposed between the inner panel and the outer panel; and an aerogel coating layer formed at least one of between the inner panel and the main insulation material and between the outer panel and the main insulation material.

The refrigerator may further include: an inner door configured to open and close a front opening of the main body, disposed in the storage compartment, and separate an independent storage space from the storage compartment from; and an outer door configured to open and close the independent storage space and disposed outside the inner door.

The outer door may include: an inner panel; an outer panel disposed outside the inner panel; a main insulation material disposed between the inner panel and the outer panel; and an aerogel coating layer formed at least one of between the inner panel and the main insulation material and between the outer panel and the main insulation material.

The refrigerator may further include a home bar door including an inner panel and an outer panel disposed outside the inner panel and configured to selectively open and close the main body, wherein a main insulation material is disposed between the inner panel and the outer panel, and the aerogel coating layer is formed at least one of between the inner panel and the main insulation material and between the outer panel and the main insulation material.

The refrigerator may further include a partition configured to partition the storage compartment into a plurality of sections, wherein an aerogel coating layer is formed in the partition.

The refrigerator may further include a machine room disposed at a rear surface of the main body, wherein an aerogel coating layer is formed around the machine room.

The refrigerator may further include a machine room case defining an appearance of the machine room, and wherein an aerogel coating layer is formed on one surface of the machine room case.

An aerogel coating layer may be formed at a cool air leak portion of the refrigerator.

The cool air leak portion may include at least one selected from the group consisting of a bent portion of the main body, an assembled structure of a rear panel of the main body, a bottom panel of the main body to which legs of the refrigerator are fixed, a flange of the main body, and a bent portion of a refrigerator door.

In accordance with another aspect of the present disclosure, there is provided a refrigerator including an insulation structure formed by coating a liquid-phase aerogel on at least one of an inner case constituting a storage compartment and an outer case coupled to an outer surface of the inner case, coupling the inner case to the outer case, and filling a main insulation material between the inner case and the outer case.

The coating of the aerogel may include spraying an aerogel coating solution by a nozzle spray method.

The coating of the aerogel may include coating an aerogel coating solution by a roller method.

The method of forming the insulation structure may further include curing the aerogel.

The aerogel may be cured by room temperature curing or heating curing.

The coupling of the inner case to the outer case may include bending the outer case and coupling the bent outer case and the inner case.

In accordance with another aspect of the present disclosure, there is provided a method of manufacturing a refrigerator including: preparing an inner case; preparing an outer case; coating a liquid-phase aerogel on at least one of a rear surface of the inner case and a front surface of the outer case as an auxiliary insulation material; coupling the inner case to the outer case; and disposing a main insulation material between the inner case and the outer case.

The coating of the aerogel may be performed by spraying an aerogel coating solution by a nozzle spray method.

The coating of the aerogel may include coating an aerogel coating solution by a roller method.

The method may further include curing the aerogel.

The curing of the aerogel may be performed by room temperature curing or heating curing.

The coupling of the inner case to the outer case may include bending the outer case and coupling the bent outer case and the inner case.

In accordance with another aspect of the present disclosure, there is provided a home appliance having an insulation structure including: a first panel; a second panel facing the first panel; a main insulation material disposed between the first panel and the second panel; and an aerogel coating layer formed at least one of between the first panel and the main insulation material and between the second panel and the main insulation material.

The home appliance may include at least one of a refrigerator and a cooking device.

Advantageous Effects

The refrigerator according to the present disclosure may have the following effects.

First, as an aerogel is used as an auxiliary insulation material, the amount of conventionally used high-cost vacuum insulation materials may decrease, thereby reducing manufacturing costs.

Also, since the aerogel is used as a coating layer, heat-insulating performance of an insulation wall of a refrigerator may be improved without increasing a thickness of the insulation wall. Thus, power consumption may decrease and a sufficient storage space may be obtained.

In addition, since the aerogel is used as a coating layer, a flow path of urethane is broadened while filling urethan. Thus, a uniform insulation structure may be obtained.

Also, since an insulation wall may be formed simply by coating an aerogel coating solution on the insulation wall of the refrigerator or a main insulation material and curing the solution, the insulation structure may be efficiently applied to bent portions. Thus, a manufacturing process may be performed efficiently.

BRIEF DESCRIPTION OF THE DRAWINGS

FIG. 1 is a perspective view illustrating an appearance of a refrigerator according to an embodiment.

FIG. 2 is a perspective view illustrating the inside of the refrigerator of FIG. 1.

FIG. 3 is a side cross-sectional view of the refrigerator of FIG. 1 taken along line AA'.

FIG. 4A is a cross-sectional view illustrating a structure of a refrigerator main body in which an aerogel coating layer is disposed between an outer case of a refrigerator main body and a main insulation material.

FIG. 4B is a cross-sectional view illustrating a structure of a refrigerator main body in which an aerogel coating layer having a greater thickness than that of FIG. 4A is disposed.

FIG. 4C is a cross-sectional view illustrating a structure of a refrigerator main body in which a plurality of aerogel coating layers is disposed.

FIG. 4D is a cross-sectional view illustrating a structure of a refrigerator main body in which an aerogel coating layer is disposed between an inner case of the refrigerator main body and a main insulation material FIG. 4E is a cross-sectional view illustrating a structure of a refrigerator main body in which aerogel coating layers are disposed between an outer case of the refrigerator main body and a main insulation material and between an inner case of the refrigerator main body and the main insulation material.

FIG. 5 is a cross-sectional view illustrating a structure of a refrigerator main body including an aerogel sheet applied to a rear surface of the refrigerator main body.

FIG. 6 is a partially exploded view of a structure of a refrigerator in which an aerogel is applied to a bent portion of an outer case of a refrigerator main body as a cool air leak portion.

FIG. 7 is a diagram illustrating a coupling structure of a partition to an inner case of a refrigerator according to an embodiment.

FIG. 8 is a cross-sectional view of the partition of FIG. 7 taken along line BB'.

FIG. 9A is a cross-sectional view of a freezer compartment door in which an aerogel coating layer is disposed between an inner panel of the freezer compartment door and a main insulation material among storage compartment doors according to an embodiment.

FIG. 9B is an exploded perspective view illustrating a structure of the freezer compartment door of FIG. 9A.

FIG. 9C is a cross-sectional view of a freezer compartment door in which an aerogel coating layer is disposed between an outer panel and a main insulation material.

FIG. 9D is a cross-sectional view of a freezer compartment door in which aerogel coating layers are disposed between an inner panel and a main insulation material and between an outer panel and a main insulation material.

FIG. 10 is a cross-sectional view of a freezer compartment door including an aerogel sheet.

FIG. 11A is a cross-sectional view of a structure in which an aerogel coating layer is disposed between a bottom panel of a refrigerator main body and a main insulation material.

FIG. 11B is a cross-sectional view of a structure in which an aerogel coating layer is disposed on one surface of a bottom panel of a refrigerator main body facing a machine room.

FIG. 11C is a cross-sectional view of a structure in which aerogel coating layers are disposed between a bottom panel of a refrigerator main body and a main insulation material and on one surface of the bottom panel of the refrigerator main body facing a machine room.

FIG. 11D is a cross-sectional view of a structure in which an aerogel coating layer is disposed between a machine room case and a bottom panel of a refrigerator main body.

FIG. 11E is a cross-sectional view of a structure in which an aerogel coating layer is disposed on one surface of a machine room case facing a machine room.

FIG. 11F is a cross-sectional view of a structure in which aerogel coating layers are disposed between a machine room case and a bottom panel of a refrigerator main body and on one surface of the machine room case facing a machine room.

FIG. 12 is a perspective view illustrating an appearance of a refrigerator including a home bar.

FIG. 13 is a perspective view illustrating the home bar door illustrated in FIG. 12 separated from a refrigerator compartment door.

FIG. 14 is a cross-sectional view of the home bar door of FIG. 13 taken along line CC'.

FIG. 15 is a cross-sectional view of the home bar door including an aerogel sheet disposed therein.

FIG. 16 is a perspective view illustrating an appearance of a refrigerator according to an embodiment having a double door structure.

FIG. 17 is a cross-sectional view of an outer door of FIG. 16 taken along line DD'.

FIG. 18 is a cross-sectional view of a transparent outer door according to another embodiment.

FIG. 19 is a cross-sectional view of a cooking device having an insulation structure.

FIG. 20 is a flowchart for describing a method of manufacturing a refrigerator according to an embodiment.

FIG. 21 is a flowchart for describing a method of manufacturing a refrigerator according to another embodiment.

BEST MODE

Reference will now be made in detail to the embodiments of the present disclosure, examples of which are illustrated in the accompanying drawings. The embodiments described in the specification and shown in the drawings are only illustrative and are not intended to represent all aspects of the invention, such that various equivalents and modifications may be made without departing from the spirit of the invention. In the drawings, like reference numerals denote like elements, and elements may be enlarged or exaggerated for clarity.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Throughout the specification, the term "insulation material" may be classified into a "main insulation material" having main heat-insulating function and an "auxiliary insulation material" to supplement the function of the main insulation material.

Also, a "rear surface of an inner case" and "a front surface of an outer case" may be defined as one surface of an inner case in contact with the main insulation material and one surface of an outer case in contact with the main insulation material, respectively.

Hereinafter, embodiments of the present disclosure will be described in detail with reference to the accompanying drawings.

FIG. 1 is a perspective view illustrating an appearance of a refrigerator 100 according to an embodiment. FIG. 2 is a perspective view illustrating the inside of the refrigerator 100 of FIG. 1. FIG. 3 is a side cross-sectional view of the refrigerator 100 of FIG. 1 taken along line AA'.

Referring to FIGS. 1 to 3, the refrigerator 100 according to an embodiment includes a refrigerator main body 105, storage compartments 120 and 150 formed in the refrigerator main body 105, storage compartment doors 130, 140, and 200 to shield the insides of the storage compartments 120 and 150 from the outside, and a cool air supply device (not shown) to supply cool air into the storage compartments 120 and 150.

The refrigerator main body 105 having a box-shape may include an inner case 111 defining the storage compartments 120 and 150, an outer case 112 coupled to outer surfaces of the inner case 111 and defining an appearance of the refrigerator 100, and an insulation material filled between the inner case 111 and the outer case 112 to prevent an outflow of cool air from the storage compartments 120 and 150 and an inflow of external warm air into the storage compartments 120 and 150.

The inner case 111 may be formed by injection-molding a resin material, and the outer case 112 may be formed by pressing an iron plate.

The insulation material may include a main insulation material 110 mainly performing heat insulation functions and an auxiliary insulation material supplementing the functions of the main insulation material 110.

The main insulation material 110 may include at least one of a filled and cured foam insulation material, a pre-processed foam insulation material, and a vacuum insulation panel (VIP).

When using the filled and cured foam insulation material, the refrigerator 100 may have an insulation structure formed by assembling the inner case 111 and the outer case 112 and injecting and foaming a urethane foaming solution between the inner case 111 and the outer case 112. When using the pre-processed foam insulation material, the refrigerator 100 may have an insulation structure formed by simultaneously assembling the inner case 111, the outer case 112, and the insulation material. When using the vacuum insulation panel (VIP), the refrigerator 100 may have an insulation structure formed by filling the VIP and urethane foam. Aerogel may be used as the auxiliary insulation material.

The outer case 112 may include a top panel 113 defining an upper appearance of the refrigerator 100, side panels 114 and 115 defining side appearances of the refrigerator 100, a bottom panel 116, and a rear panel 117 defining a rear appearance of the refrigerator 100. The top panel 113, the side panels 114 and 115, the bottom panel 116, and the rear panel 117 may be flat. The outer case 112 may have a structure in which the top panel 113 and the side panels 114 and 115 are integrally formed and the rear panel 117 and the bottom panel 116 may be detachable and may also have various structures within a range obvious to those of ordinary skill in the art.

A machine room 190 may be disposed at a lower part of a real side of the refrigerator main body 105. The machine room 190 may be defined by a bent structure of the bottom panel 116 of the refrigerator main body 105 or a separate machine room case 191. That is, a portion of the bottom panel 116 may serve as the machine room case 191 or a separate machine room case 191 may also be provided. Although the separate machine room case 191 is illustrated in FIG. 3 for descriptive convenience, the embodiment is not limited thereto.

Constituent elements of the cool air supply device (not shown), e.g., a compressor 192, may be disposed in the machine room 190. The constituent elements disposed in the machine room 190 are supported by a machine room bottom panel 193. A machine room cover 194 is disposed at a rear surface of the machine room 190 and the machine room 190 may be opened and closed by the machine room cover 194.

Since a refrigerant is compressed to a high temperature and high pressure refrigerant by the compressor 192 in the machine room 190, a large amount of heat is generated therein. Thus, an aerogel coating layer may be applied to one surface of the machine room case 191, the machine room cover 194, or the machine room bottom panel 193 to prevent transfer of heat generated in the machine room 190 to the storage compartments 120 and 150. Detailed descriptions thereof will be given later.

The storage compartments 120 and 150 may be partitioned into an upper refrigerator compartment 120 and a lower freezer compartment 150 by a partition 123. Although a bottom freeze type refrigerator 100 in which the freezer compartment located at a lower portion thereof is exemplarily described according to the present embodiment, the embodiment is not limited thereto. The embodiment may also be applied to a side by side type refrigerator 100 in which a freezer compartment 150 and a refrigerator compartment 120 are located at left and right sides thereof, a top mount type refrigerator 100, or any refrigerator 100 having combinations of these features.

The partition 123 may be fabricated separately from the refrigerator main body 105 and coupled to the inner case. The partition 123 is horizontally coupled to both side walls and a rear wall of the inner case to divide the storage compartment into the upper refrigerator compartment 120 and the lower freezer compartment 150. The partition 123 may have a thermally insulated structure to perform heat exchange between the storage compartments partitioned by the partition 123. Detailed descriptions thereof will be given later.

The refrigerator compartment 120 is maintained at about 3° C. and stores food in a chilled state. The refrigerator compartment 120 may include shelves 121 on which food is placed and at least one storage box 122 to store food.

An ice making chamber 125 may be disposed at an upper corner of the refrigerator compartment 120 and separated from the refrigerator compartment 120 by an ice making chamber case 126. An ice maker 127 including an ice maker tray and an ice bucket to store ices produced by the ice maker tray are disposed in the ice making chamber 125.

The refrigerator compartment 120 may include a water tank 133 to store water. The water tank 133 may be disposed between a plurality of storage boxes 122 as illustrated in FIG. 2. However, the embodiment is not limited thereto, and the water tank 133 may be disposed at any position in the refrigerator compartment 120 such that water contained in the water tank 133 is cooled by the cool air flowing in the refrigerator compartment 120.

The water tank 133 may be connected to an external water supply line such as a water supply facility and store purified water purified by a filter. A water supply pipe connecting the external water supply line and the water tank 133 may be provided with a flow path switching valve and water may be supplied into the ice maker 127 via the flow path switching valve.

The refrigerator compartment 120 has an open front to put/take food into/out of the refrigerator compartment 120. A pair of doors 130 and 140 hinged to the refrigerator main body 105 may open and close the open front of the refrigerator compartment 120. Refrigerator compartment door handles 131 and 141 may be provided at front surfaces of the refrigerator compartment doors 130 and 140 to open and close the refrigerator compartment doors 130 and 140.

The refrigerator compartment doors 130 and 140 may have an insulation structure to prevent an outflow of cool air from the refrigerator compartment 120 and an inflow of external warm air into the refrigerator compartment 120. The insulation structure of the refrigerator compartment doors 130 and 140 will be described later.

Door guards 132 and 142 may be mounted on rear surfaces of the refrigerator compartment doors 130 and 140 to store food. Also, a gasket 134 may be mounted along boundaries of the rear surfaces of the refrigerator compartment doors 130 and 140 to prevent an outflow of cool air from the refrigerator compartment 120 by sealing gaps between the refrigerator compartment doors 130 and 140 and the refrigerator main body 105 when the refrigerator compartment doors 130 and 140 are closed. A rotation bar 135 may be provided at one of the refrigerator compartment doors 130 and 140 to prevent an outflow of cool air from the refrigerator compartment 120 by sealing gaps between the refrigerator compartment doors 130 and 140 when the refrigerator compartment doors 130 and 140 are closed.

A dispenser 145 may be disposed at one of the refrigerator compartment doors 130 and 140 allowing a use to obtain purified water, carbonated water, or ice stored in the refrigerator compartment doors 130 and 140 from the outside thereof without opening the refrigerator compartment doors 130 and 140.

The dispenser 145 may have a dispensing space into which a container such as a cup to obtain water or ice is inserted and include a dispenser lever 146 to operate the dispenser 145 to discharge purified water, carbonated water, or ice and a dispenser nozzle 147 through which purified or carbonated water is discharged. The user may input a command to discharge carbonated water or purified water to the refrigerator 100 by pressing the dispenser lever 146 and a command to stop discharging carbonated water or purified water by stopping the pressing of the dispenser lever 146. That is, the refrigerator 100 discharges purified water or carbonated water until the pressing of the dispenser lever 146 is stopped after pressing of the dispenser lever 146 is started.

Also, the dispenser 145 may further include an ice guiding path connecting the ice maker 127 with the dispensing space such that ice produced by the maker 127 is discharged into the dispensing space.

Meanwhile, a carbonated water making module 155 to produce carbonated water may be mounted on the rear surfaces of the refrigerator compartment doors 130 and 140 provided with the dispenser 145.

The carbonated water making module 155 produces carbonized water in the refrigerator 100. The carbonated water making module 155 may include a module case including a carbon dioxide cylinder to store high-pressure carbon dioxide, a carbonized water tank to produce carbonized water by mixing purified water with carbon dioxide and store the produced carbonized water, and a space to accommodate the carbon dioxide cylinder and the carbonized water tank and coupled to the rear surfaces of the refrigerator compartment doors 130 and 140, and an integrated valve assembly to control the flow of purified water or carbonized water.

A control panel 165 to receive an input of a command to control the refrigerator 100 from the user and to display operation information of the refrigerator 100 may be provide at one of the refrigerator compartment doors 130 and 140. The control panel 165 may be a touch panel implemented using a capacitive type touch panel, a resistive type touch panel, an infrared type touch panel, or an ultrasound acoustic type, without being limited thereto.

The freezer compartment 150 may store food in a frozen state by maintaining the inside thereof at or below about −18° C. to. The freezer compartment 150 may have an open front to put/take food into/out of the freezer compartment 150. The open front of the freezer compartment 150 may be opened and closed by a freezer compartment door 200 sliding forward and backward. A storage box 160 may be provided at the rear surface of the freezer compartment door 200.

Movable rails 170 may be coupled to the freezer compartment door 200 and the storage box 160 and slidably supported by fixed rails 180 mounted on the refrigerator main body 105. Thus, the freezer compartment door 200 and the storage box 160 may slide into/out of the refrigerator main body 105. A freezer compartment door handle 290 may be disposed at the front surface of the freezer compartment door 200 to open and close the freezer compartment door 200.

The cool air supply device may include a compressor 192, a condenser (not shown), an expansion valve (not shown), an evaporator (not shown), a fan (not shown), and the like.

A schematic structure of the refrigerator 100 according to an embodiment has been described above. Hereinafter, an aerogel applied to an insulation structure of the refrigerator 100 according to an embodiment will be described, and then application examples of the aerogel in the insulation structure of the refrigerator 100 will be described in more detail for descriptive convenience.

Aerogel is a compound word of "aero" indicating air and "gel" indicating solidified liquid. Aerogel is the lightest solid material on Earth having a low density and more than 98% of a volume of aerogel is composed of gas.

More particularly, aerogel has a structure in which silicon oxide ($SiO_2$) is loosely interlaced with nano-sized pores therein. Thus, the aerogel may function as an auxiliary insulation material since the aerogel reduces heat transfer or nano pores formed in the aerogel reduce transfer of radiant energy.

Due to a brittle structure of the aerogel despite high stability thereof, the aerogel needs to be prepared and processed into a form in accordance with desired purposes while maintaining intrinsic properties thereof. However, the intrinsic properties of the aerogel such as heat-insulating property may be destroyed while being processed, and thus there is a need use a suitable processing technique depending on the purposes of the aerogel.

For example, an aerogel may be applied to a product in the form of a coating solution. If an aerogel coating solution is prepared by using an organic binder, the organic binder may block pores of the aerogel, and thus heat-insulating performance thereof may decrease. If an aerogel coating solution is prepared by using an inorganic binder, the inorganic binder does not block pores of the aerogel, and thus heat-insulating performance of the aerogel may be maintained. Thus, heat-insulating performance of the aerogel may be maintained by adjusting types of the binder and an amount of the binder while preparing the aerogel coating solution.

An aerogel applied to an insulation structure of the refrigerator according to an embodiment may be prepared according to the following method.

First, alkoxysilane as a metal alkoxide, such as tetramethoxysilane (TMOS) and tetraethoxysilane (TEOS), and waterglass are provided as raw materials. When alcohol and an additive are added to an alkoxide mixture in a liquid state and maintained in a frame, alcogel in a gel state is prepared. By adding the alcogel to a drying chamber and flowing a supercritical fluid (supercritical $CO_2$) thereinto at a high temperature under a high pressure, alcohol is substituted with the supercritical fluid (supercritical $CO_2$). The supercritical fluid (supercritical $CO_2$) may be flowed to prevent a volume change caused by difference of surface tensions as the liquid attached to the surface of the solid evaporates into gas. After substituting the alcohol in a liquid state contained in the drying container with the supercritical fluid (supercritical $CO_2$), the temperature and pressure are slowly lowered to room temperature and atmospheric pressure. Then, the alcogel is removed from the drying chamber to replace the supercritical fluid (supercritical $CO_2$) with air, thereby producing aerogel.

The aerogel manufactured according to the aforementioned process are generally provided in powder or bead form and may be processed into various shapes by adding a binder and the like thereto.

For example, the aerogel may be processed into a coating solution after being mixed with a liquid and a binder. The aerogel may also be processed into a paste by adjusting the concentration of the powder and beads of the aerogel. The aerogel may also be combined with a fibrous skeleton to be processed into a sheet (or blanket).

If the aerogel processed as a coating solution is applied to the insulation structure of the refrigerator, an aerogel coating layer may be mounted on one surface of the outer case or the inner case of the refrigerator. Examples of the aerogel applied to various structures of the refrigerator will be described later.

The aerogel coating layer may be formed by spraying the aerogel coating solution using a nozzle or by applying the aerogel coating solution using a roller. In this case, the aerogel coating solution may include at least one of an organic binder coating solution, an inorganic binder coating solution, and a waterborne coating solution.

After applying the aerogel coating solution to the surface, a process of curing the coating solution may be performed by room-temperature curing or heating curing.

When the aerogel is provided in the form of a coating solution, an insulation wall having improved heat-insulating performance may be provided without increasing a thickness of the insulation wall. Also, a wider flow path of urethane may be obtained while filling urethane.

For example, an insulation wall structure of a refrigerator having a thickness of 50 mm may be configured by using 50 mm of only the main insulation material 110, using 2 mm of the aerogel coating layer and 48 mm of the main insulation material 110, or 10 mm of an aerogel sheet and 40 mm of the main insulation material 110.

Since an aerogel has better heat-insulating property than urethane, the insulation wall structure formed of 2 mm of the aerogel coating layer and 48 mm of the main insulation material 110 provides better heat-insulating performance than the insulation wall structure formed of 50 mm of the main insulation material 110. Thus, power consumption may be reduced without increasing the thickness of the insulation wall. Heat-insulating performance of the aerogel will be described later.

Also, since the insulation structure formed of 2 mm of the aerogel coating layer and 48 mm of the main insulation material 110 provides a wider flow path of urethane than the insulation structure formed of 10 mm of the aerogel sheet and 40 mm of the main insulation material 110. Thus, influence of a urethane flow may be minimized during formation of the insulation structure. That is, a manufacturing process may be simplified.

Meanwhile, since the aerogel has better heat-insulating property than urethane, the same heat-insulating performance may be obtained by a thinner insulation wall using the aerogel coating layer and urethane simultaneously, when compared with the insulation wall formed of only the main insulation material 110. Thus, a refrigerator may have a wider storage compartment than those having the same volume.

Also, when the aerogel is applied in the form of a coating solution, the insulation wall may be formed by applying the aerogel coating solution to a portion of the surfaces or the entire surfaces of the inner case 111, the outer case 112, or the main insulation material 110 and curing the solution. Thus, the coating solution may be easily applied to a bent portion.

The aerogel sheet may be prepared by combining fibers and the aerogel or by surface-treating colloidal silica prepared from water glass with silane. The aerogel sheet processed as described above has excellent mechanical properties and may be applied to various insulation structures of the refrigerator 100.

By providing the aerogel in a sheet form, an aerogel coating process may be dispensed with. The aerogel sheet may replace an expensive vacuum insulation panel (VIP) and the insulation structure may be implemented with lower manufacturing costs. Meanwhile, if required, the vacuum insulation panel VIP) may also be used.

The aerogel processed in a sheet form may be used to prevent the outer case 112 of the refrigerator main body 105 or the storage compartment doors 130, 140, and 200 from bending. In this case, the aerogel sheet may replace a non-woven fabric sheet generally used to prevent bending of the refrigerator main body 105 or the storage compartment doors 130, 140, and 200. Thus, an insulation structure realizing improved heat-insulating performance may be provided.

If the aerogel is provided in a paste form, the aerogel may be applied to a cool air leak portion of the insulation structure of the refrigerator 100. In general, an insulation structure of the refrigerator 100 is formed by filling a urethan foaming liquid into an insulating space and curing the filled urethan foam. A sealing agent such as a hot melt and a foam melt may be used to prevent leakage of the foaming liquid.

Since such sealing agent has low heat-insulating performance, vapor condensation may occur at a sealed portion. Thus, the aerogel paste may be applied to the cool air leak portion to further improve heat-insulating performance.

The aerogel may be cryogenic aerogel or pyrogenic aerogel.

The cryogenic aerogel blocks cold air, and the pyrogenic aerogel blocks hot air. Thus, the cryogenic aerogel may be applied between the inner case 111 of the refrigerator main body 105 and the main insulation material 110 to prevent an outflow of cool air from the storage compartments 120 and 150. The pyrogenic aerogel may be applied between the outer case 112 of the refrigerator main body 105 and the main insulation material 110 to prevent an inflow of external air into the storage compartments 120 and 150.

However, applications of the cryogenic aerogel and the pyrogenic aerogel are not limited thereto. The cryogenic aerogel may also be applied between the outer case 112 of the refrigerator main body 105 and the main insulation material 110, or the pyrogenic aerogel may also be applied between the inner case 111 of the refrigerator main body 105 and the main insulation material 110.

The aerogel applied to the insulation structure of the refrigerator 100 according to an embodiment has been described above. Hereinafter, application examples of the aerogel in the insulation structure of the refrigerator 100 will be described in more detail.

First, application examples of the aerogel in the refrigerator main body 105 will be described.

The refrigerator main body 105 may include the inner case 111 defining storage compartments 120 and 150 therein, the outer case 112 coupled to outer surfaces of the inner case 111 and defining an appearance of the refrigerator 100, the main insulation material 110 disposed between the inner case 111 and the outer case 112, and an aerogel disposed at least one of between the inner case 111 and the main insulation material 110 and between the outer case 112 and the main insulation material 110. The inner case 111, the outer case 112, and the main insulation material 110 are as described above, and descriptions thereof will not be repeated.

The aerogel may be applied to an insulation structure of the refrigerator main body 105 as a coating layer, a sheet, or a paste. FIG. 4A illustrates a structure of the refrigerator main body 105 in which an aerogel coating layer C1 is disposed between the outer case 112 of the refrigerator main body 105 and the main insulation material 110. FIG. 4B illustrates a structure of the refrigerator main body 105 in which an aerogel coating layer C1' having a greater thickness than that of FIG. 4A is disposed. FIG. 4C illustrates a structure of the refrigerator main body 105 in which a plurality of aerogel coating layers C1*a* and C1*b* are disposed between the outer case 112 of the refrigerator main body 105 and the main insulation material 110. FIG. 4D illustrates a structure of the refrigerator main body 105 in which an aerogel coating layer C2 is disposed between the inner case 111 of the refrigerator main body 105 and the main insulation material 110. FIG. 4E illustrates a structure of the refrigerator main body 105 in which the aerogel coating layers C1 and C2 are disposed between the outer case 112 of the refrigerator main body 105 and the main insulation material 110 and between the inner case 111 of the refrigerator main body 105 and the main insulation material 110. FIG. 5 is a cross-sectional view illustrating a structure of the refrigerator main body 105 including an aerogel sheet applied to a rear surface of the refrigerator main body 105. FIG. 6 is a partially exploded view of a structure of the refrigerator 100 in which an aerogel is applied to a bent portion of the outer case 112 of the refrigerator main body 105 as a cool air leak portion.

Referring to FIG. 4A, the aerogel coating layer C1 may be disposed between the outer case 112 of the refrigerator main body 105 and the main insulation material 110, more particularly, between at least one of the top panel 113, the side panels 114 and 115, the bottom panel 116, and the rear panel 117 of the refrigerator main body 105 and the main insulation material 110. That is, an insulation wall outer case 112 may be formed in the order of the outer case 112 of the refrigerator main body 105, the aerogel coating layer C1, the main insulation material 110, and the inner case 111 of the refrigerator main body 105.

The aerogel coating layer C1 may be disposed on a portion of the surfaces or the entire surfaces of the top panel 113, the side panels 114 and 115, the bottom panel 116, and the rear panel 117. The aerogel coating layer C1 disposed between the outer case 112 of the refrigerator main body 105 and the main insulation material 110 may be formed of a pyrogenic aerogel to prevent an inflow of external warm air into the storage compartments 120 and 150.

The aerogel coating layer C1 may be formed by coating an aerogel coating solution on one surface of the refrigerator main body 105 or one surface of the main insulation material 110 and curing the coated solution.

The aerogel coating layer C1 may be disposed between the outer case 112 of the refrigerator main body 105 and the main insulation material 110 in a state of being bonded to one surface of the outer case 112 of the refrigerator main body 105 in contact with the main insulation material 110. Hereinafter, the aerogel coating layer C1 disposed between the outer case 112 of the refrigerator main body 105 and the main insulation material 110 or between the inner case 111 of the refrigerator main body 105 and the main insulation material 110 may be understood as an aerogel coating layer C1 disposed on one surface of the outer case 112 of the refrigerator main body 105 in contact with the main insulation material 110 or on one surface of the inner case 111 of the refrigerator main body 105 in contact with the main insulation material 110 in a broad sense.

The main insulation material 110 may include at least one of the filled and cured foam insulation material, the pre-processed foam insulation material, and the vacuum insulation panel (VIP) as described above. Hereinafter, the aerogel coating layer C1 disposed between the outer case 112 of the refrigerator main body 105 and the main insulation material 110 or between the inner case 111 of the refrigerator main body 105 and the main insulation material 110 may also be understood as an aerogel coating layer C1 bonded to one surface of the pre-processed foam insulation material or the vacuum insulation panel (VIP) in a broad sense.

The aerogel coating layer may have various thicknesses. More particularly, the aerogel coating layer C1 may have a thickness of about 0.2 to about 20 mm. As illustrated in FIG. 4B, as the thickness of the aerogel coating layer C1 increases, heat-insulating performance may further be improved in comparison with that of FIG. 4A.

For example, a cluster pipe (not shown) may be disposed on both side walls, a rear wall, or a top wall of the refrigerator main body 105 to increase heat exchange efficiency. Since the cluster pipe (not shown) dissipates high-temperature heat, a rigid insulation structure is required to prevent heat transfer into the storage compartments 120 and 150. Thus, if the cluster pipe (not shown) is disposed, the thickness of the aerogel coating layer C1 disposed on the side walls, the rear wall, or the top wall of the refrigerator main body 105 needs to be increased.

Also, the aerogel coating layer C1 may be disposed in multiple layers as illustrated in FIG. 4C. FIG. 4C exemplarily illustrates double aerogel coating layers C1*a* and C1*b*, without being limited thereto.

If multiple aerogel coating layers C1 are used, heat-insulating performance may be improved. Hereinafter, improvement of heat-insulating performance in case of using a single aerogel coating layer C1 and multiple aerogel coating layers C1 will be respectively described with reference to Table 1 below.

TABLE 1

| | Including aerogel coating layer | | | Not including aerogel coating layer | | |
|---|---|---|---|---|---|---|
| | Sample 1 | Sample 2 | Average | Sample 3 (single layer) | Sample 4 (multiple layers) | Average |
| Temperature of refrigerator compartment 120 (° C.) | 3.0 | 2.5 | 2.8 | 2.8 | 2.6 | 2.7 |
| Temperature of freezer compartment 150 (° C.) | −21.6 | −22 | −21.8 | −21.8 | −21.9 | −21.9 |
| Surface temperature of compressor (° C.) | 50.0 | 50.7 | 50.4 | 49.7 | 50.8 | 50.3 |
| Temperature of refrigerant discharged to condenser (° C.) | 51.5 | 51.8 | 51.7 | 50.7 | 52.0 | 51.4 |
| Operating rate of refrigerator (%) | 59.6 | 64.2 | 61.9 | 58.5 | 62.4 | 60.5 |
| Average operating cycle (min) | 66.8 | 57.3 | 62.1 | 63.3 | 58.5 | 60.9 |
| Monthly power consumption (kWh/month) | 23.7 | 25.3 | 24.5 | 23.4 | 24.9 | 24.2 |

Table 1 shows test results of refrigerators 100 including the aerogel coating layer and not including the aerogel coating layer under the condition that an ambient temperature was 25° C., an internal temperature of the refrigerator compartment 120 was 3° C., and an internal temperature of the freezer compartment 150 was −18° C. For the tests, temperatures of the refrigerator compartments 120 and the freezer compartments 150, surface temperatures of the compressors 191, temperatures of refrigerants discharged to the condensers, operating rates of the refrigerators 100, average operating cycles, and monthly power consumptions were measured.

In Sample 1, cool air is supplied from a left side of a storage compartment of a refrigerator 100 not including an aerogel coating layer. In Sample 2, cool air is supplied from a right side of a storage compartment of a refrigerator 100 not including an aerogel coating layer. In Sample 3, cool air is supplied from a left side of a storage compartment of a refrigerator 100 including an aerogel coating layer formed by coating an aerogel coating solution once. In Sample 4, cool air is supplied from a right side of a storage compartment of a refrigerator 100 including an aerogel coating layer by coating the aerogel coating solution twice.

First, it will be described that heat-insulating performance may be improved when the aerogel coating layers C1, C1*a*, and C1*b* are used by comparing the average of Samples 1 and 2 with the average of Samples 3 and 4.

Referring to Table 1, in Samples 3 and 4 including the aerogel coating layers C1, C1*a*, and C1*b*, the average internal temperature of the refrigerator compartment 120 was 2.7° C. and the average internal temperature of the freezer compartment 150 was −21.9° C. which were lower than the average internal temperature of the refrigerator compartment 120 and the average internal temperature of the average and freezer compartment 150 of Samples 1 and 2. Also, the average surface temperature of the compressor 191 of Samples 3 and 4 was 50.3° C. which was lower than the average surface temperature of the compressor 191 of Samples 1 and 2 not including the aerogel coating layers C1, C1*a*, and C1*b*. In addition, Samples 3 and 4 exhibited improved results of operating rates, average operating cycles, and monthly power consumptions.

That is, it was confirmed that the refrigerators 100 including the aerogel coating layers C1, C1*a*, and C1*b* had better heat-insulating performance than the refrigerator 100 not including the aerogel coating layers C1, C1*a*, and C1*b*.

Next, it will be described that heat-insulating performance may be improved when a plurality of aerogel coating layers C1*a* and C1*b* are used by comparing values of Samples 1 and 3 with those of Samples 2 and 4.

Samples 1 and 3 were compared with each other and Samples 2 and 4 were compared with each other in terms of the monthly power consumption. The monthly power consumption of Sample 3 including a single aerogel coating layer C1 was 98.7% of that of Sample 1 not including the aerogel coating layer C1, and thus it was confirmed that the monthly power consumption of Sample 3 was lower than that of Sample 1 by about 1.3%. The monthly power consumption of Sample 4 including double aerogel coating layers C1*a* and C1*b* was 98.4% of that of Sample 2 not including the aerogel coating layers C1*a* and C1*b*, and thus it was confirmed that the monthly power consumption of Sample 4 was lower than that of Sample 2 by about 1.6%.

That is, it was confirmed that the monthly power consumption may be improved by the double aerogel coating layers C1*a* and C1*b* when compared with the single aerogel coating layer C1.

Referring to FIG. 4D, the aerogel coating layer C2 of the refrigerator 100 according to an embodiment may be disposed between the inner case 111 of the refrigerator main body 105 and the main insulation material 110. That is, an insulation wall may be formed in the order of the outer case 112 of the refrigerator main body 105, the main insulation material 110, the aerogel coating layer C2, and the inner case 111 of the refrigerator main body 105.

The aerogel coating layer C2 may be disposed on a portion of the surface or the entire surface of the inner case 111 of the refrigerator main body 105. The aerogel coating layer C2 disposed between the inner case 111 of the refrigerator main body 105 and the main insulation material 110 may be formed of a cryogenic aerogel to prevent an outflow of cool air from the storage compartments 120 and 150 to the outside.

The inner case 111 of the refrigerator main body 105 may be formed by injection-molding a resin material and have more bent portions than the outer case 112 of the refrigerator main body 105. Thus, the aerogel coating layer may be formed on the inner case 111 of the refrigerator main body 105 by coating the aerogel coating solution and curing the coated solution.

Also, the aerogel coating layer C2 may have various thicknesses or be disposed in multiple stacked layers. Hereinafter, descriptions of the aerogel coating layer C2 presented above with reference to FIGS. 4*a* to 4C will not be repeated.

Referring to FIG. 4E, the aerogel coating layers C1 and C2 of the refrigerator 100 according to an embodiment may be disposed between the outer case 112 of the refrigerator main body 105 and the main insulation material 110 and between the inner case 111 of the refrigerator main body 105 and the main insulation material 110, respectively. That is, an insulation wall may be formed in the order of the outer case 112 of the refrigerator main body 105, the aerogel coating layer C1, the main insulation material 110, the aerogel coating layer C2, and the inner case 111 of the refrigerator main body 105.

The aerogel coating layers C1 and C2 may be disposed on portions of the surfaces or the entire surfaces of the inner case 111 and the outer case 112. A pyrogenic aerogel coating layer may be applied between the outer case 112 of the refrigerator main body 105 and the main insulation material 110 and a cryogenic aerogel coating layer may be applied between the inner case 111 of the refrigerator main body 105 and the main insulation material 110. Also, the aerogel coating layers C1 and C2 may have different thicknesses or be disposed in multiple stacked layers. Hereinafter, descriptions presented above will not be repeated.

Referring to FIG. 5, the refrigerator 100 according to an embodiment may include an aerogel sheet S1 disposed on a rear surface of the refrigerator main body 105.

Although FIG. 5 exemplarily illustrates that the aerogel sheet S1 is disposed between the rear panel 117 of the refrigerator main body 105 and the main insulation material 110, application examples of the aerogel sheet S1 are not limited thereto. The aerogel sheet S1 may also be disposed between the inner case 111 of a rear side of the refrigerator main body 105 and the main insulation material 110 or both between the inner case 111 of the rear side of the refrigerator main body 105 and the main insulation material 110 and between the outer case 112 of the rear side of the refrigerator main body 105 and the main insulation material 110. Also, the aerogel sheet may also be disposed on lateral sides, a lower side, or an upper side of the refrigerator main body 105 in addition to the rear side of the refrigerator main body 105.

The aerogel sheet may be disposed on a portion of the surfaces or the entire surfaces of the inner case 111 and the outer case 112 of the refrigerator main body 105 in the same manner as the aerogel coating layer. A pyrogenic aerogel sheet may be applied between the outer case 112 of the refrigerator main body 105 and the main insulation material 110, and a cryogenic aerogel sheet may be applied between the inner case 111 of the refrigerator main body 105 and the main insulation material 110.

The aerogel sheet may have various thicknesses or be disposed in multiple stacked layers. Hereinafter, descriptions presented above will not be repeated.

Referring to FIG. 6, in the refrigerator 100 according to an embodiment, an aerogel paste P1 may be applied to a bent portion of the refrigerator main body 105 located between the top panel 113 and the side panel 114 that is a cool air leak portion of the refrigerator 100.

The insulation structure of the refrigerator main body 105 may be formed by filling and curing a urethan foaming liquid as described above. In this case, the urethan foaming liquid may leak from a gap of the bent portion of the refrigerator main body 105. Thus, an aerogel paste or liquid-phase aerogel may be applied to the gap of the bent portion of the refrigerator main body 105 to prevent leakage of the urethan foaming liquid and provide an insulation wall structure of the refrigerator 100 having improved heat-insulating performance.

Although FIG. 6 exemplarily illustrates the bent portion of the refrigerator main body 105 between the top panel 113 and the side panel 114 as the cool air leak portion of the refrigerator 100, the cool air leak portion of the refrigerator 100 is not limited thereto. The cool air leak portion may be understood as any portions from which the urethan foaming liquid may leak such as the bottom panel 116 of the refrigerator main body 105 to which legs of the refrigerator 100 are fixed, a leg assembly of the refrigerator 100 (FIG. 1), a rear panel assembly of the refrigerator main body 105 (FIG. 1), and a flange of the refrigerator main body 105.

Application examples of the aerogel in the refrigerator main body 105 have been described above. Hereinafter, application examples of the aerogel in the partition 123 dividing the refrigerator main body 105 will be described.

The aerogel may be applied to an insulation structure of the partition 123 in the form of a coating layer, a sheet, or a paste. FIG. 7 is a diagram illustrating a coupling structure of the partition 123 to the inner case 111 of the refrigerator 100 according to an embodiment. FIG. 8 is a cross-sectional view of the partition 123 of FIG. 7 taken along line BB'.

Referring to FIGS. 7 and 8, the partition 123 may be separately fabricated and coupled to rails 124 provided at the inner case 111 to partition the storage compartments 120 and 150 into a plurality of sections. The partition 123 may have an insulation structure for efficient thermal insulation between the partitioned sections.

The partition 123 according to an embodiment may include a first partition 123-1, a second partition 123-2 coupled to the first partition 123-1, a main insulation material 110 disposed between the first partition 123-1 and the second partition 123-2, and an aerogel sheet S2 disposed between the first partition 123-1 and the second partition 123-2.

Although the aerogel may be provided in a sheet form as illustrated in FIG. 8, the form of the aerogel is not limited thereto. The aerogel may also be provided in the form of a coating layer or in the form of a paste or a coating solution applied to a gap between the coupled first partition 123-1 and the second partition 123-2.

Also, the aerogel sheet S2 may be disposed between the first partition 123-1 and the main insulation material 110 as illustrated in FIG. 8. However, the embodiment is not limited thereto, and the aerogel sheet S2 may also be disposed between the second partition 123-2 and the main insulation material 110 or both between the first partition 123 and the main insulation material 110 and between the second partition 123-2 and the main insulation material 110.

By applying the aerogel to the partition 123, thermal insulation may efficiently be performed between a plurality of storage compartments. Also, since the same heat-insulating performance may be obtained by using a thinner partition 123, the storage compartments 120 and 150 may have a wider space.

Application examples of the aerogel in the partition 123 have described above. Hereinafter, application examples of the aerogel in the storage compartment doors 130, 140, and 200 will be described.

The aerogel may be applied to insulation structures of the storage compartment doors 130, 140, and 200 in the form of a coating layer, a sheet, or a paste. FIG. 9A is a cross-sectional view of the freezer compartment door 200 in which an aerogel coating layer C3 is disposed between an inner panel 220 of the freezer compartment door 200 and the main insulation material 110 among the storage compartment doors 130, 140, and 200 according to an embodiment. FIG. 9B is an exploded perspective view illustrating a structure of the freezer compartment door 200 of FIG. 9A. FIG. 9C is a cross-sectional view of the freezer compartment door 200 in which an aerogel coating layer C4 is disposed between an outer panel 210 and the main insulation material 110. FIG. 9D is a cross-sectional view of the freezer compartment door 200 in which aerogel coating layers C3 and C4 are disposed between the inner panel 220 and the main insulation material 110 and between the outer panel 210 and the main insulation material 110, respectively. FIG. 10 is a cross-sectional view of the freezer compartment door 200 including an aerogel sheet S3. Although FIGS. 9A to 10 exemplarily illustrate the freezer compartment door 200, the structure to which the aerogel is applicable may be understood as any structures obvious to those of ordinary skill in the art including the refrigerator compartment doors 130 and 140.

Referring to FIGS. 9A and 9B, the freezer compartment door 200 may include the outer panel 210, the inner panel 220, an upper cap 230, and a lower cap 240. The outer panel 210, the inner panel 220, the upper cap 230, and the lower cap 240 are coupled to form an inner space.

The outer panel 210 may include a front surface 211 defining a front appearance of the freezer compartment door 200, side surfaces 212 and 213 defining both sides of the freezer compartment door 200, and coupling portions 214 and 215 coupled to the inner panel 220. The outer panel 210 may be formed by pressing an iron plate and surface-treated to enhance an exterior appearance and durability thereof.

The inner panel 220 is coupled to the rear surface of the outer panel 210 and constitutes the rear surface of the freezer compartment door 200. The inner panel 220 may be formed by injection-molding a resin material and may be surface-treated to enhance the exterior appearance and durability.

The upper cap 230 may be coupled to upper ends of the outer panel 210 and the inner panel 220. The lower cap 240 may be coupled to lower ends of the outer panel 210 and the inner panel 220. The upper cap 230 may constitute the top surface of the freezer compartment door 200, and the lower cap 240 may constitute the bottom surface of the freezer compartment door 200. The upper cap 230 and the lower cap 240 may be formed of the same material as that of the outer panel 210 or the inner panel 220.

The inner space may be a closed space, and the main insulation material 110 may be disposed in the inner space.

The aerogel may be disposed between the inner panel 220 of the freezer compartment door 200 and the main insulation material 110 in the form of a coating layer. That is, an insulation structure of the freezer compartment door 200 may be formed in the order of the outer panel 210 of the freezer compartment door 200, the main insulation material 110, the aerogel coating layer C3, and the inner panel 220 of the freezer compartment door 200.

Referring to FIG. 9C, the aerogel coating layer C4 may be disposed between the outer panel 210 of the freezer compartment door 200 and the main insulation material 110. That is, the insulation structure of the freezer compartment door 200 may be formed in the order of the outer panel 210 of the freezer compartment door 200, the aerogel coating layer C4, the main insulation material 110, and the inner panel 220 of the freezer compartment door 200.

Referring to FIG. 9D, the aerogel coating layers C3 and C4 may be disposed between the outer panel 210 of the freezer compartment door 200 and the main insulation material 110 and between the inner panel 220 of the freezer compartment door 200 and the main insulation material 110, respectively. That is, the insulation structure of the freezer compartment door 200 may be formed in the order of the outer panel 210 of the freezer compartment door 200, the aerogel coating layer C4, the main insulation material 110, the aerogel coating layer C3, and the inner panel 220 of the freezer compartment door 200.

In FIGS. 9A to 9D, the aerogel coating layers C3 and C4 may be disposed on a portion of the surfaces of the entire surfaces of the inner panel 220 and the outer panel 210 of the freezer compartment door 200.

Also, a cryogenic aerogel may be applied between the inner panel 220 of the freezer compartment door 200 and the main insulation material 110 to prevent an outflow of cool air from the freezer compartment 150 to the outside, and a pyrogenic aerogel may be applied between the outer panel 210 of the freezer compartment door 200 and the main insulation material 110 to prevent an inflow of external warm air into the freezer compartment 150.

Also, the aerogel coating layers C3 and C4 may be formed by coating an aerogel coating solution and curing the coated solution. In this case, the aerogel coating layers C3 and C4 may be disposed in a state of being bonded to the inner panel 220 of the freezer compartment door 200 or the outer panel 210 of the freezer compartment door 200.

In addition, the aerogel coating layers C3 and C4 may have different thicknesses of about 0.2 to about 20 mm. If required, multiple layers thereof may be stacked.

Referring to FIG. 10, the aerogel may be disposed between the outer panel 210 of the freezer compartment door 200 and the main insulation material 110 in a sheet form. That is, the insulation structure of the freezer compartment door 200 may be formed in the order of the outer panel 210 of the freezer compartment door 200, the aerogel sheet S3, the main insulation material 110, and the inner panel 220 of the freezer compartment door 200.

Although FIG. 10 exemplarily illustrates the aerogel sheet S3 disposed between the outer panel 210 of the freezer compartment door 200 and the main insulation material 110, application examples of the aerogel sheet S3 are not limited thereto. The aerogel sheet S3 may also be disposed between the inner panel 220 of the freezer compartment door 200 and the main insulation material 110 or both between the inner panel 220 of the freezer compartment door 200 and the main insulation material 110 and between the outer panel 220 of the freezer compartment door 200 and the main insulation material 110. The aerogel sheet S3 may also be disposed in various ways within a range obvious to those of ordinary skill in the art.

Although not shown, the aerogel may also be applied to a cool air leak portion of the freezer compartment door 200 in form of a paste or a coating solution. That is, the aerogel may be applied to coupled portions between the inner panel 220, the outer panel 210, the upper cap 230, and the lower cap 240 of the freezer compartment door 200 to prevent leakage of the urethan foaming liquid and provide the insulation structure of the freezer compartment door 200 having improved heat-insulating performance. Hereinafter, descriptions presented above with reference to FIG. 6 will not be repeated.

Application examples of the aerogel in the storage compartment doors 130, 140, and 200 have been described above. Hereinafter, application examples of the aerogel in the machine room 190 will be described.

The refrigerator 100 according to an embodiment may include the machine room 190 located at a rear portion of the refrigerator main body 105. The compressor 192 disposed in the machine room 190 may generate a large amount of heat during operation of the refrigerator 100. Thus, a highly efficient insulation structure is required around the machine room 190 to block transfer of heat generated in the machine room 190 into the storage compartments 120 and 150.

Thus, the aerogel may be applied to an insulation structure of the machine room 190 in the form of a coating layer, a sheet, or a paste. Application examples in the sheet form and the paste form are as described above. Hereinafter, application examples of the aerogel in the form of the coating layer will be described.

FIG. 11A is a cross-sectional view of a structure in which an aerogel coating layer C5 is disposed between the bottom panel 116 of the refrigerator main body 105 and the main insulation material 110. FIG. 11B is a cross-sectional view of a structure in which an aerogel coating layer C6 is disposed on one surface of the bottom panel 116 of the refrigerator main body 105 facing the machine room 190. FIG. 11C is a cross-sectional view of a structure in which the aerogel coating layers C5 and C6 are disposed between the bottom panel 116 of the refrigerator main body 105 and the main insulation material 110 and on one surface of the bottom panel 116 of the refrigerator main body 105 facing the machine room 190, respectively. FIG. 11D is a cross-sectional view of a structure in which an aerogel coating layer C7 is disposed between the machine room case 191 and the bottom panel 116 of the refrigerator main body 105. FIG. 11E is a cross-sectional view of a structure in which an aerogel coating layer C8 is disposed on one surface of the machine room case 191 facing the machine room 190. FIG. 11F is a cross-sectional view of a structure in which the aerogel coating layers C7 and C8 are disposed between the machine room case 191 and the bottom panel 116 of the refrigerator main body 105 and on one surface of the machine room case 191 facing the machine room 190, respectively.

Referring to FIG. 11A, the refrigerator 100 according to an embodiment may include the aerogel coating layer C5 disposed between the bottom panel 116 of the refrigerator main body 105 and the main insulation material 110. That is, an insulation structure may be formed in the order of the bottom panel 116 of the refrigerator main body 105, the aerogel coating layer C5, the main insulation material 110, and the inner case 111 of the refrigerator main body 105.

Referring to FIG. 11B, the refrigerator 100 according to an embodiment may include the aerogel coating layer C6 disposed on one surface of the bottom panel 116 of the refrigerator main body 105 facing the machine room 190. That is, an insulation structure may be formed in the order of the aerogel coating layer C6, the bottom panel 116 of the refrigerator main body 105, the main insulation material 110, and the inner case 111 of the refrigerator main body 105.

Referring to FIG. 11C, the refrigerator 100 according to an embodiment may include the aerogel coating layers C5 and C6 disposed between the bottom panel 116 of the refrigerator main body 105 and the main insulation material 110 and on one surface of the bottom panel 116 of the refrigerator main body 105 facing the machine room 190, respectively. That is, an insulation structure may be formed in the order of the aerogel coating layer C6, the bottom panel 116 of the refrigerator main body 105, the aerogel coating layer C5, the main insulation material 110, and the inner case 111 of the refrigerator main body 105.

Referring to FIG. 11D, the refrigerator 100 according to an embodiment may further include the separate machine room case 191, and the aerogel coating layer C7 may be disposed between the machine room case 191 and the bottom panel 116 of the refrigerator main body 105. That is, an insulation structure may be formed in the order of the machine room case 191, the aerogel coating layer C7, the bottom panel 116 of the refrigerator main body 105, the main insulation material 110, and the inner case 111 of the refrigerator main body 105.

Referring to FIG. 11E, the refrigerator 100 according to an embodiment may further include a separate machine room case 191, and the aerogel coating layer C8 may be disposed between the machine room case 191 facing the machine room 190. That is, an insulation structure may be formed in the order of the aerogel coating layer C8, the machine room case 191, the bottom panel 116 of the refrigerator main body 105, the main insulation material 110, and the inner case 111 of the refrigerator main body 105.

Referring to FIG. 11F, the refrigerator 100 according to an embodiment may further include the separate machine room case 191, and the aerogel coating layers C7 and C8 may be disposed between the machine room case 191 and the bottom panel 116 of the refrigerator main body 105 and on one surface of the machine room case 191 facing the machine room 190, respectively. That is, an insulation structure may be formed in the order of the aerogel coating layer C8, the machine room case 191, the aerogel coating layer C7, the bottom panel 116 of the refrigerator main body 105, the main insulation material 110, and the inner case 111 of the refrigerator main body 105.

Although FIGS. 11E and 11F exemplarily illustrate the aerogel coating layers C7 and C8 disposed on one surface of the machine room case 191, examples thereof are not limited thereto. The aerogel coating layer may also be disposed on the machine room bottom panel 193 or the machine room cover 194.

A pyrogenic aerogel may be applied to the aerogel coating layers C5, C6, C7, and C8 to prevent an inflow of heat generated in the machine room 190 into the storage compartments 120 and 150.

In addition, the aerogel coating layers C5, C6, C7, and C8 may be disposed on a portion of the surface of the entire surface of the bottom panel 116 of the refrigerator main body 105. When disposed on a portion of the bottom panel 116 of the refrigerator main body 105, the aerogel coating layers C5, C6, C7, and C8 may be disposed on a portion of one surface of the bottom panel 116 of the refrigerator main body 105 in contact with the machine room 190 to effectively block transfer of heat generated in the machine room 190.

Also, the aerogel coating layers C5, C6, C7, and C8 may be formed by coating an aerogel coating solution and curing the coated solution. In this case, the aerogel coating layers C5, C6, C7, and C8 may be disposed in a state of being bonded to the bottom surface 116 of the refrigerator 100.

In addition, the aerogel coating layers C5, C6, C7, and C8 may have different thicknesses of about 0.2 to about 20 mm. According to the present embodiment, the thicknesses of the aerogel coating layers C5, C6, C7, and C8 may be greater than those of the other regions of the refrigerator 100 to effectively block transfer of heat generated by the compressor 191 accommodated in the machine room 190.

Also, the aerogel coating layers C5, C6, C7, and C8 may be disposed in multiple stacked layers. In this case, heat-insulating performance may be improved.

Application examples of the aerogel in the machine room 190 have been described.

Then, an insulation structure of a refrigerator including a home bar according to an embodiment will be described. Descriptions presented above with regard to application examples of the aerogel except for the insulation structure with reference to FIGS. 1 to 11 will not be repeated.

The aerogel may be applied to an insulation structure of the home bar door in the form of a coating layer, a sheet, or a paste. FIG. 12 is a perspective view illustrating an appearance of a refrigerator 100*a* according to an embodiment including a home bar 300*a* (FIG. 13). FIG. 13 is a perspective view illustrating a home bar door 301*a* illustrated in FIG. 12 separated from a refrigerator compartment door 140*a*. FIG. 14 is a cross-sectional view of the home bar door 301*a* of FIG. 13 taken along line CC'. FIG. 15 is a cross-sectional view of the home bar door 301*a* including an aerogel sheet S4 disposed therein.

Referring to FIGS. 12 and 13, the refrigerator 100*a* according to an embodiment may include a main body 105*a*, storage compartments 120*a* and 150*a* disposed in the main body 105*a*, storage compartment doors 130*a*, 140*a*, and 200*a* to shield the insides of the storage compartments 120*a* and 150*a* from the outside, a home bar 300*a* installed in the storage compartment doors 130*a*, 140*a*, and 200*a* and having a separate storage space, and a home bar door 301*a* installed at a front door of the home bar 300*a* to open and close the home bar 300*a*.

Such structure allows the user to conveniently put/take beverages or alcoholic drinks through the home bar door 301*a* smaller than the storage compartment doors 130*a*, 140*a*, and 200*a* without opening the storage compartment doors 130*a*, 140*a*, and 200*a*

The front surfaces of the storage compartment doors 130*a*, 140*a*, and 200*a* have an opening 331*a* through which the user approaches to the home bar 300*a*. A gasket 332*a* may be mounted along boundaries of the opening 331*a* to be in close contact with the rear surface of the home bar door 301*a* to prevent an outflow of cool air to the outside.

Referring to FIG. 14, the home bar door 301*a* may include an outer panel 302*a*, an inner panel 303*a*, an upper cap (not shown), and a lower cap (not shown). The outer panel 302*a*, the inner panel 303*a*, the upper cap (not shown), and the lower cap (not shown) may be coupled to form an inner space.

The inner space may be a closed space, and the main insulation material 110*a* may be disposed in the inner space.

The aerogel may be disposed between the outer panel 302*a* of the home bar door 301*a* and the main insulation material 110*a* in the form of a coating layer. That is, an insulation structure of the home bar door 301*a* may be formed in the order of the outer panel 302*a* of the home bar door 301*a*, the aerogel coating layer C9, the main insulation material 110*a*, and the inner panel 303*a* of the home bar door 301*a*. However, arrangement of the aerogel coating layer is not limited thereto. The aerogel coating layer C9 may also be disposed between the main insulation material 110*a* and the inner panel 303*a* of the home bar door 301*a* or both between the main insulation material 110*a* and the outer panel 302*a* of the home bar door 301*a* and between the main insulation material 110*a* and the inner panel 303*a* of the home bar door 301*a*.

The aerogel coating layer C9 may be disposed on a portion of the surfaces of the entire surfaces of the outer panel 302*a* of the home bar door 301*a* or the inner panel 303*a* of the home bar door 301*a*.

In addition, a cryogenic aerogel may be applied between the inner panel 303*a* of the home bar door 301*a* and the main insulation material 110*a* to prevent an outflow of cool air from the home bar 300*a* to the outside, and a pyrogenic aerogel may be applied between the outer panel 302*a* of the home bar door 301*a* and the main insulation material 110*a* to prevent an inflow of external warm air into the home bar 300*a*.

Also, the aerogel coating layer C9 may be formed by coating an aerogel coating solution and curing the coating solution. In this case, the aerogel coating layer C9 may be disposed in a state of being bonded to the inner panel 303*a* of the home bar door 301*a* or the outer panel 302*a* of the home bar door 301*a*.

In addition, the aerogel coating layer C9 may have different thicknesses of about 0.2 to about 20 mm. If required, multiple aerogel coating layers C9 may be stacked.

Referring to FIG. 15, the aerogel may be disposed between the outer panel 302*a* of the home bar door 301*a* and the main insulation material 110*a* in a sheet form. That is, the insulation structure of the home bar door 301*a* may be formed in the order of the outer panel 302*a* of the home bar door 301*a*, the aerogel sheet S4, the main insulation material 110*a*, and the inner panel 303*a* of the home bar door 301*a*.

Although FIG. 15 exemplarily illustrates the aerogel sheet S4 disposed between the outer panel 302*a* of the home bar door 301*a* and the main insulation material 110*a*, application examples of the aerogel sheet S4 are not limited thereto. The aerogel sheet S4 may also be disposed between the inner panel 303*a* of the home bar door 301*a* and the main insulation material 110*a* or both between the inner panel 303*a* of the home bar door 301*a* and the main insulation material 110*a* and between the outer panel 302*a* of the home bar door 301*a* and the main insulation material 110*a*. The aerogel sheet S4 may also be disposed in various ways within a range obvious to those of ordinary skill in the art.

Application examples of the aerogel sheet S4 in the home bar door 301*a* are as described above with reference to FIG. 10, and thus descriptions thereof will not be repeated.

Also, the aerogel may be applied to a cool air leak portion of the home bar door 301*a* in the form of a paste or a coating solution. Application examples thereof are as described above with reference to FIG. 6, and thus descriptions thereof will not be repeated.

Application examples of the aerogel in the home bar door 301*a* have been described.

Hereinafter, an insulation structure of the refrigerator 100*b* having a double door structure will be described. Descriptions presented above with regard to application examples of the aerogel with reference to FIGS. 1 to 11 except for the insulation structure of the double door will not be repeated.

FIG. 16 is a perspective view illustrating an appearance of a refrigerator 100*b* having a double door structure 140-1*b* and 140-2*b*. FIG. 17 is a cross-sectional view of an outer door 140-2*b* of FIG. 16 taken along line DD'. FIG. 18 is a cross-sectional view of a transparent outer door 140-2*b* according to another embodiment.

Referring to FIG. 16, the refrigerator 100*b* according to an embodiment may include a refrigerator main body 105*b*, an inner door 140-1*b*, and an outer door 140-2*b*.

Although a side by side type refrigerator 100*b* in which a freezer compartment 150*b* and a refrigerator compartment 120*b* are located at left and right sides in the refrigerator main body 105*b* is exemplarily described according to the present embodiment, the embodiment is not limited thereto. The embodiment may also be applied to a bottom freeze type refrigerator, a top mount type refrigerator, and any refrigerator having combinations of these features.

The inner door 140-1*b* is hinged to the refrigerator main body 105*b* and forms an independent storage space in the refrigerator compartment 120*b* to shield the refrigerator compartment 120*b* from the outside. Hereinafter, the refrigerator compartment 120*b* formed in the refrigerator main body 105*b* is defined as a first space 120-1*b*, and the independent storage space partitioned by the inner door 140-1*b* is defined as a second space 120-2*b*.

The outer door 140-2*b* is hinged to the refrigerator main body 105*b* together with the inner door 140-1*b* at an outer position than the inner door 140-1*b* to open and close the second space 120-2*b*. That is, the outer door 140-2*b* may be configured to open only the outer door 140-2*b*, and the inner door 140-1*b* may be configured to open both the inner door 140-1*b* and the outer door 140-2*b*.

Since the outer door 140-2*b* is designed to be thinner than general refrigerator compartment doors (FIGS. 1 to 3), vapor condensation may occur. Thus, insulation structures as illustrated in FIGS. 17 and 18 may be applied to the outer door 140-2*b*.

Referring to FIG. 17, the outer door 140-2*b* may include an outer panel 210*b*, an inner panel 220*b*, an upper cap (not shown), and a lower cap (not shown). The outer panel 210*b*, the inner panel 220*b*, the upper cap (not shown), and the lower cap (not shown) are coupled to form an inner space.

The inner space may be filled with a main insulation material 110*b*, and an aerogel may be disposed between the outer panel 210*b* and the main insulation material 110*b*. Although FIG. 17 illustrates an insulation structure in which an aerogel sheet S5 is disposed between the outer panel 210*b* and the main insulation material 110*b*, the embodiment is not limited thereto. The insulation structure including the aerogel paste described above with reference to FIG. 6 and the insulation structures of the storage compartment doors 130, 140, and 200 described above with reference to FIGS. 9 and 10 may also be applied thereto. Hereinafter, descriptions about the insulation structures presented above will not be repeated.

Referring to FIG. 18, the outer door 140-2*b* may include an outer panel 210*b*, an inner panel 220*b*, an upper cap (not shown), and a lower cap (not shown). The outer panel 210*b*, the inner panel 220*b*, the upper cap (not shown), and the lower cap (not shown) are coupled to form an inner space.

The outer door 140-2*b* may be formed of a transparent material and the inner space may include a light transmitting aerogel A. Aerogels generally include nanopores having a diameter of 10 to 30 nm, and light transmittance of the aerogels may be adjusted by controlling the pore diameter.

Since the light-transmitting aerogel A is disposed in the inner space, the outer door 140-2*b* may have a structure including design diversity, user convenience, and excellent heat-insulating performance.

Application examples of the aerogel in the refrigerator 100*b* having a double door structure have been described.

Hereinafter, an insulation structure of a home appliance according to an embodiment will be described.

A home appliance according to an embodiment has an insulation structure formed of a first panel, a second panel facing the first panel, a main insulation material disposed between the first panel and the second panel, and an aerogel disposed at least one of between the first panel and the main insulation material and between the second panel and the main insulation material.

The home appliance may include all types of home appliances including cooking devices requiring an insulation structure as well as the aforementioned refrigerator 100. The aerogel may be applied to the insulation structure of the home appliance in at least one form of a coating layer, a sheet, and a paste.

Hereinafter, the insulation structure of the home appliance will be described based on a cooking device having an insulation structure including an aerogel.

FIG. 19 is a cross-sectional view of a cooking device 400 having an insulation structure according to an embodiment.

Referring to FIG. 19, the cooking device 400 according to an embodiment may include a main body 410, a cooking chamber 420 formed in the main body 410, and a door 430 to open and close a front opening of the cooking chamber 420.

The cooking chamber 420 refers to a space in which food is cooked and may be defined by a top panel 421, a bottom panel 422, side panels (not shown), and a rear panel 424. Various parts of the cooking device 400 may be aligned in a space between the cooking chamber 420 and the main body 410.

A fan cover 440 may be coupled to an outer surface of the rear panel 424. A convection fan 441 may be disposed between the rear panel 424 and the fan cover 440 to circulate air through the cooking chamber 420. At least one electric heater 442 may be installed at the convection fan 441, and a driving motor 443 connected to the convection fan 441 may be installed between the fan cover 440 and the main body 410.

In order to thermally insulate the cooking chamber 420 from the outside, an aerogel sheet S5 may be disposed on outer surfaces of the top panel 421, the bottom panel 422, the side panels (not shown), and the fan cover 440 constituting the cooking chamber 420.

Although FIG. 19 exemplarily illustrates the insulation structure including the aerogel sheet S5, the embodiment is not limited thereto and the aerogel may also be applied to the insulation structure in the form of a coating layer or a paste within a range obvious to those of ordinary skill in the art.

The insulation structure of the aerogel has been described above. Hereinafter, a method of manufacturing the refrigerator will be described.

A method of manufacturing a refrigerator according to an embodiment includes preparing an inner case 111, preparing an outer case 112, coating a liquid-phase aerogel on at least one of a rear surface of the inner case 111 and a front surface of the outer case 112 as an auxiliary insulation material, coupling the inner case 111 to the outer case 112, and disposing a main insulation material 110 between the inner case 111 and the outer case 112.

The coating of the aerogel may be performed by coating the aerogel by spraying an aerogel coating solution using a nozzle (nozzle spray method) or by coating the aerogel by using a roller (roller method). However, coating methods of the aerogel are not limited thereto.

According to the nozzle spraying method, an aerogel coating solution having a viscosity suitable for spraying is sprayed using a nozzle by a pressure device. The nozzle spray method may simply be used in a structure to which the roller method cannot be applied. For example, since the inner case 111 is an injection-molded product, and the surface thereof has various bent portions. In this case, the aerogel coating solution may be sprayed by the nozzle spray method to form an aerogel coating layer on the surface of the inner case 111.

According to the roller method, an aerogel coating solution having a uniform viscosity is provided between rollers. An aerogel coating layer is formed while an iron plate passes between the rollers. While the iron plate passes between the rollers, the aerogel coating solution spread on the surfaces of rotating rollers is applied to the surfaces of the iron plate. According to this method, an aerogel coating layer may be formed.

After coating the aerogel coating solution on at least one of the outer case 112 and the inner case 111, the coated aerogel coating solution may be cured. The curing may be performed by room temperature curing or heating curing, without being limited thereto.

Hereinafter, the method of manufacturing the refrigerator will be described in more detail.

FIG. 20 is a flowchart for describing a method of manufacturing a refrigerator according to an embodiment.

Referring to FIG. 20, the method of manufacturing a refrigerator may include coating the aerogel coating solution on the outer case 112 (510), curing the coated aerogel coating solution (511), bending the outer case 112 on which the aerogel coating layer is formed (512), assembling the bent outer case 112 and the inner case 111 prepared by injection-molding (513), and injecting and foaming a urethane foaming solution between the outer case 112 and the inner case 111 (514).

The coating of the outer case 112 with of aerogel coating solution may include coating the aerogel coating solution on one surface of the outer case 112 of the main body 105 constituting the inside of the insulation structure of the refrigerator 100, more particularly, coating the aerogel coating solution on at least one of the top panel, the side panels, the bottom panel, and the rear panel 117 of the outer case 112.

The coating may be performed by the nozzle spray method and the roller method as described above, and descriptions presented above will not be repeated. The thickness of the aerogel coating layer may be adjusted in accordance with a coating time, the number of coatings, and the like during a coating process. More particularly, the aerogel coating layer may have a thickness of about 0.2 to about 20 mm (510).

After coating the aerogel coating solution, a process of curing the aerogel coating solution may be performed by room temperature curing or heating curing as described above (511).

After curing the aerogel coating solution, a process of bending the outer case 112 may be performed. The outer case 112 may be bent to a "⊏" shape in accordance with a desired shape of the refrigerator 100 (512).

After bending the outer case 112, the inner case prepared by injection-molding is coupled to the bent outer case 112. The outer case 112 bent in the "⊏" shape may constitute the rear panel 117 and the side panels of the refrigerator 100. In this case, the rear panel 117 of the refrigerator 100 may be assembled to an assembled structure of the outer case 112 and the inner case 111, and the machine room case 191 may further be assembled to the assembled structure. However, assembling examples of the main body 105 are not limited thereto and may include modifications within a range obvious to those of ordinary skill in the art (513).

After assembling of the outer case 112 and the inner case 111 is completed, a urethane foaming solution is injected and foamed between the outer case 112 and the inner case 111 to complete manufacture of the refrigerator 100 (514).

Meanwhile, the aerogel coating layer may be formed on one surface of the rear panel 117 of the refrigerator 100 and the machine room case 191. A process of forming the aerogel coating layer on the rear panel 117 of the refrigerator 100 and the machine room case 191 may be performed simultaneously or separately from the process of manufacturing the refrigerator 100.

FIG. 21 is a flowchart for describing a method of manufacturing a refrigerator according to another embodiment.

Referring to FIG. 21, the method of manufacturing the refrigerator may include coating the aerogel coating solution on the inner case 111 (520), curing the coated aerogel coating solution (521), assembling the inner case 111 on which the aerogel coating layer is formed and the outer case 112 (522), and injecting and foaming a urethane foaming solution between the inner case 111 and the outer case 112 (523).

The coating of the inner case 111 with the aerogel coating solution may include coating the aerogel coating solution on one surface of the inner case 111 constituting the inside of the insulation structure of the refrigerator 100, more particularly, coating the aerogel coating solution on a portion of the surface or the entire surface of the inner case 111.

The coating of the inner case 111 may be performed by the nozzle spray method. Since the inner case 111 is an injection-molded product, and the surface thereof has various bent portions. Thus, the nozzle spray method is more suitable to form the coating layer than the roller method. The thickness of the aerogel coating layer may be adjusted in accordance with a coating time, the number of coatings, and the like during a coating process. More particularly, the aerogel coating layer may have a thickness of about 0.2 to about 20 mm (520).

After coating the aerogel coating solution, a process of curing the aerogel coating solution may be performed by room temperature curing or heating curing as described above (521).

After curing the aerogel coating solution, the inner case 111 on which the aerogel coating layer is formed and the prepared outer case 112 are assembled. The outer case 112 may have a "⊏"-shaped bent structure as a basic structure. The outer case 112 bent into the "⊏" shape may constitute the top panel and the side panels of the refrigerator 100. In this case, the rear panel 117 of the refrigerator 100 is assembled to an assembled structure of the outer case 112 and the inner case 111 and the machine room case 191 may further be assembled to the assembled structure. However, assembling examples of the refrigerator main body 105 are not limited thereto and may include modifications within a range obvious to those of ordinary skill in the art (522).

After assembling of the outer case 112 and the inner case 111 is completed, a urethane foaming solution is injected and foamed between the outer case 112 and the inner case 111 to complete manufacture of the refrigerator 100 (523).

Meanwhile, the aerogel coating layer may be formed on one surface of the rear panel 117 of the refrigerator 100 and the machine room case 191. A process of forming the aerogel coating layer on the rear panel 117 of the refrigerator 100 and the machine room case 191 may be performed simultaneously or separately from the process of manufacturing the refrigerator 100.

The method of manufacturing the refrigerator has been described above. Although the method of manufacturing the refrigerator including the aerogel coating layer formed on one surface of the outer case 112 or one surface of the inner case 111 has been described, the methods of manufacturing the refrigerator are not limited thereto.

The embodiments are described based on the manufacturing process of the refrigerator main body 105. However, the method of manufacturing the refrigerator including coating the aerogel coating solution may also be applied to various insulation structures including the insulation structure of a door of a general refrigerator 100, the insulation structure of a door of the refrigerator 100*b* including double doors 140-1*b* and 140-2*b*, the insulation structure of the home bar door 301*b*, the insulation structure of the partition 123 of the storage compartments 120 and 150, the insulation structure of the machine room case 191, and the insulation structure of the storage container in addition to the insulation structure of the main body 105 of the refrigerator 100.

The refrigerator 100 including the aerogel coating layers C1 and C2, C3, C4, C5, C6, C7, C8, and C9 and the manufacturing method thereof have been described above. It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A refrigerator comprising:

a main body comprising an inner case constituting a storage compartment and an outer case disposed outside the inner case;

a main insulation material disposed between the inner case and the outer case; and an aerogel coating layer formed on, at least a portion of a rear surface of the inner case or at least a portion of a front surface of the outer case or both the at least a portion of the rear surface and the at least a portion of the front surface, by coating and curing a liquid-phase aerogel, wherein the aerogel coating layer serves as an auxiliary insulation material of the main insulation material.

2. The refrigerator according to claim 1, wherein the aerogel coating layer is formed by curing an aerogel coating solution selected from the group consisting of an organic binder coating solution, an inorganic binder coating solution, and a waterborne coating solution by room temperature curing or heating curing.

3. The refrigerator according to claim 1, wherein the aerogel coating layer comprises at least one selected from the group consisting of a cryogenic aerogel and a pyrogenic aerogel, wherein the aerogel coating layer is formed on an entire rear surface of the inner case or an entire front surface of the outer case or both the entire rear surface and the entire front surface.

4. The refrigerator according to claim 1, wherein the aerogel coating layer is formed on the at least a portion of the rear surface of the inner case in contact with the main insulation material, or the at least a portion of the front surface of the outer case in contact with the main insulation material or both the at least a portion of the rear surface in contact with the main insulation material and the at least a portion of the front surface in contact with the main insulation material, wherein the main insulation material comprises at least one selected from the group consisting of a filled and cured foam insulation material, a pre-processed foam insulation material, and a vacuum insulation panel (VIP).

5. The refrigerator according to claim 1, further comprising a door comprising:

an inner panel;

an outer panel disposed outside the inner panel;

a main insulation material disposed between the inner panel and the outer panel; and an aerogel coating layer formed between the inner panel and the main insulation material or between the outer panel and the main insulation material or between the inner panel and the main insulation material and between the outer panel and the main insulation material.

6. The refrigerator according to claim 1, wherein the door is an outer door and the refrigerator further comprising an inner door configured to open or close a front opening of the main body, disposed in between the outer door and the storage compartment, and the inner door having an independent storage space separated from the storage compartment, wherein the outer door is configured to open or close the independent storage space and disposed outside the inner door, and wherein the outer door comprises:

an inner panel;

an outer panel disposed outside the inner panel;

a main insulation material disposed between the inner panel and the outer panel; and an aerogel coating layer formed between the inner panel and the main insulation material or between the outer panel and the main insulation material or between the inner panel and the main insulation material and between the outer panel and the main insulation material.

7. The refrigerator according to claim 1, further comprising a home bar door comprising an inner panel and an outer panel disposed outside the inner panel and configured to selectively open or close the main body, wherein a main insulation material is disposed between the inner panel and the outer panel, and the aerogel coating layer is formed between the inner panel and the main insulation material or between the outer panel and the main insulation material or between the inner panel and the main insulation material and between the outer panel and the main insulation material.

8. The refrigerator according to claim 1, further comprising a partition configured to partition the storage compartment into a plurality of sections, wherein an aerogel coating layer is formed in the partition.

9. The refrigerator according to claim 1, further comprising a machine room disposed at a rear surface of the main body, and a machine room case defining an appearance of the machine room, wherein an aerogel coating layer is formed around the machine room, and wherein an aerogel coating layer is formed on one surface of the machine room case.

10. The refrigerator according to claim 1, wherein an aerogel coating layer is formed at a cool air leak portion of the refrigerator, wherein the cool air leak portion comprises at least one selected from the group consisting of a bent portion of the main body, an assembled structure of a rear panel of the main body, a bottom panel of the main body to which legs of the refrigerator are fixed, a flange of the main body, and a bent portion of a refrigerator door.

11. A refrigerator comprising an insulation structure formed by using a method comprising:

coating a liquid-phase aerogel on an inner case constituting a storage compartment or an outer case coupled to an outer surface of the inner case or both the inner case and the outer case;

coupling the inner case to the outer case; and filling a main insulation material between the inner case and the outer case.

12. The refrigerator according to claim 11, wherein the coating method of the aerogel comprises at least one selected from the group consisting of spraying an aerogel coating solution by a nozzle spray method and coating an aerogel coating solution by a roller method.

13. The refrigerator according to claim 11, wherein the method of forming the insulation structure further comprises curing the aerogel by room temperature curing or heating curing.

14. The refrigerator according to claim 11, wherein the coupling of the inner case to the outer case comprises bending the outer case and coupling the bent outer case and the inner case.

15. A home appliance having an insulation structure, the insulation structure comprising:

a first panel;

a second panel facing the first panel;

a main insulation material disposed between the first panel and the second panel; and an aerogel coating layer formed between the first panel and the main insulation material or between the second panel and the main insulation material or between the first panel and the main insulation material and between the second panel and the main insulation material by coating and curing a liquid-phase aerogel.

16. The home appliance according to claim 15, wherein the home appliance is a refrigerator or a cooking device.

* * * * *